US006849999B1

(12) United States Patent
Kobayashi et al.

(10) Patent No.: US 6,849,999 B1
(45) Date of Patent: Feb. 1, 2005

(54) SUBSTRATE FOR ELECTRON SOURCE, ELECTRON SOURCE AND IMAGE FORMING APPARATUS, AND MANUFACTURING METHOD THEREOF

(75) Inventors: Tamaki Kobayashi, Isehara (JP); Masaaki Shibata, Ninomiya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/440,535

(22) Filed: Nov. 16, 1999

(30) Foreign Application Priority Data

Nov. 18, 1998 (JP) ..... 10-328586
Nov. 10, 1999 (JP) ..... 11-319396

(51) Int. Cl.[7] ..... H01J 1/30
(52) U.S. Cl. ..... 313/495; 313/310; 313/512
(58) Field of Search ..... 313/495, 309, 313/336, 351, 310, 512

(56) References Cited

U.S. PATENT DOCUMENTS 4,954,744 A 9/1990 Suzuki et al. ..... 313/336
6,184,610 B1 * 2/2001 Shibata et al. ..... 313/309

FOREIGN PATENT DOCUMENTS

| | | |
|---|---|---|
| EP | 0 850 892 A1 | 7/1998 |
| EP | 0 865 931 | 9/1998 |
| JP | 60015644 | 1/1985 |
| JP | 07331450 | 12/1995 |
| JP | 8-180801 | 7/1996 |
| JP | 09293448 | 11/1997 |
| JP | 10188854 | 7/1998 |
| JP | 10-241550 | 9/1998 |

OTHER PUBLICATIONS

C.A. Mead, "Opeeration of Tunnel–Emission Devices", Journal of Applied Physics, Apr. 1961, pp. 646–652.

M.I. Elinson et al., "The Emission of Hot Electrons and The Field Emission of Electrons From Tin Oxide", Radio Engineering and Electronic Physics, Jul. 1965, pp. 1290–1296.

H. Araki, "Electroforming and Electron Emission of Carbon Thin Films", Journal of the Vacuum, Society of Japan, 1983, pp. 22–29 (with English Abstract).

G. Dittmer, "Electrical Conduction and Electron Emission of Discontinuous Thin Films", Thin Solid Films, 9, 1972, pp. 317–328.

M. Hartwell, "Strong Electron Emission From Patterned Tin–Indium Oxide Thin Films", IEDM, 1975, pp. 519–521.

C.A. Spindt, "Physical Properties of Thin–Film Emission Cathodes with Molybdenum Cones", J. Applied Physics, vol. 47, No. 12, Dec. 1976, pp. 5248–5263.

J. Dyke et al., "Field Emission", Advances In Electronics and Electron Physics, vol. VIII, 1956, pp. 89–185.

* cited by examiner

*Primary Examiner*—Ashok Patel
(74) *Attorney, Agent, or Firm*—Fitzpatrick, Cella, Harper & Scinto

(57) ABSTRACT

A substrate for an electron source to be used for forming the electron source, the electron source and an image forming apparatus in which the substrate has been used, and manufacturing method thereof. The substrate to form the electron source in which an electron emission device is disposed includes a substrate containing Na, a first layer wish $SiO_2$ as a main component having been formed on the substrate, and a second layer containing electron conductive oxide. The electron source includes the substrate and the electron emission device disposed on the first layer or the second layer. The image forming apparatus includes the electron source and an image forming member to form an image with irradiation of electrons emitted from the electron source. According to a manufacturing method of the substrate for forming the electron source with which the electron emission device is formed, the first layer with $SiO_2$ as its main component, and the second layer containing electron conductive oxide are formed on a substrate containing Na. The manufacturing method of an electron source includes a step in which the first layer with $SiO_2$ as its main component, and the second layer containing electron conductive oxide are formed on a substrate containing Na, and a step of forming an electron emission device on the first layer or on the second layer.

11 Claims, 17 Drawing Sheets

SUBSTRATE FOR ELECTRON SOURCE, ELECTRON SOURCE AND IMAGE FORMING APPARATUS, AND MANUFACTURING METHOD THEREOF

BACKGROUND OF THE INVENTION

1. Field of the Invention

The present invention relates to a substrate for an electron source which is to be used for forming the electron source, the electron source and an image forming apparatus in which the substrate has been used, and manufacturing method thereof.

2. Related Background Art

Conventionally, as an electron emission device, generally two kinds respectively using thermoelectronic emission device and cold cathode emission device are known. There are field emission type (hereinafter referred to as an FE type), metal/insulation layer/metal type (hereinafter referred to as MIM type) and surface conduction electron emission device, etc. for cold cathode electron emission device. As examples of the FE type, those which have been disclosed in W. P. Dyke and W. W. Dolan, "Field emission," Advance in Electron Physics, 8,89 (1956) or C. A. Spindt, "Physical Properties of Thin-Film Field Emission Cathodes with Molybdenium Cones," J. Appl. Phys., 47,5248 (1976), etc. are known. As examples of the MIM type, those which are disclosed in C. A. Mead, "Operation of Tunnel-Emission Devices," J Apply. Phys., 32,646 (1961), etc. are known. As examples for the surface conduction electron emission device type, there are those which have been disclosed in M. I. Elinson, Radio Eng. Electron Phys., 10, 1290, (1965), etc. The surface conduction electron emission device is to utilize phenomena giving rise to the electron emission by making a current flow in parallel with the film surface at a small area of a film formed on a substrate. For this surface conduction electron emission device, the one utilizing $SnO_2$ film by aforementioned Elinson et al, the one involving Au film [G. Dittmer, Thin Solid Films, 9,317 (1972)], the one involving $In_2O_3/SnO_2$ film [M. Hartwell and C. G. Fonstad, IEEE Trans. ED Conf." 519 (1975)], and the one involving carbon film [Hisashi Araki, et al, Shinku, vol. 26, the first issue, page 22 (1983)], etc. have been reported.

For the purpose of holding the electron source, which has been configured by a plurality of electron emission devices such as those described above having been disposed on the substrate, inside an enclosure whose interior portion has been held vacuum, and of using the electron source, it is necessary to implement junction between the electron source and the enclosure and other members. This junction is commonly implemented with flit glass by heating and melt-contacting. The heating temperature at this time is typically around 400 to 500° C., and the time period depends on the sizes, etc. of the enclosure or the like, around ten minutes to one hour is typical.

Incidentally, as quality for the enclosure, soda-lime glass is preferably used from the point of view that joint is implemented easily and without fail, and is comparatively low-cost with flit glass. In addition, high strain point glass, which distortion point has been raised with a part of Na having been replaced with K, can also be preferably used since its flit connection is easy. In addition, as concerns the substrate of the above-described electron source, in terms of its quality, similarly, soda-lime glass, or the above-described high strain point glass is preferably used from the point of view of their certainty of junction with the enclosure.

In the above-described soda-lime glass, as component thereof, an alkali metal element, especially Na is contained in large quantity as $Na_2O$. Since the Na element easily gives rise to diffusion due to heat, when it is exposed to a high temperature during a processing, Na is diffused into respective members having been formed on the soda-lime glass, especially the member configuring the electron emission device, giving rise to changes in its features in some cases.

In addition, in case of using the aforementioend high strain point glass as the substrate of the electron source, the above-described influence due to Na is relieved to some extent according to a cut in contained quantity of Na, but nevertheless, it has been found out that similar problems takes place.

As means for reducing said Na's influence, in Japanese Patent Application Laid-Open No. 10-241550 specification, for example, EP-A-850892 specification, disclosed is a substrate for forming the electron source wherein density of the said contained Na in the surface layer region at the party where at least the electron emission device of the substrate containing Na is disposed has become smaller than the other regions, and moreover, the substrate for forming the electron source comprising a layer containing phosphorus. And on the other hand, the substrate on which the electron source is formed normally comprises insulating materials, and therefore, in the case where driving takes place under circumstances that a high voltage to be used for the purpose of causing electron emission has been applied, charge-up phenomena take place in the portion where the substrate is exposed, and in the case where no measures have not been taken whatsoever, it could become impossible to implement long-term stable drive, or the tracks of electrons emitted from the electron source will be disturbed, thus the electron emission features could change according to the lapse of time.

As means for reducing the influence by said charge-up, in U.S. Pat. No. 4,954,744 specification, for example, or Japanese Patent Application Laid-Open No. 8-180801 specification, it has been disclosed that the substrate surface or the electron emission device surface is covered by a charging prevention film comprising sheet resistance of $10^8$ to $10^{10}$ Ω/□.

SUMMARY OF THE INVENTION

Thus, the purpose of the present invention is to provide a substrate for forming an electron source in which changes according to the lapse of time in the electron emission features of the electron emission device are reduced, and the manufacturing method thereof.

In addition, the purpose of the present invention is to provide an electron source in which changes according to the lapse of time in the electron emission features of the electron emission device are reduced, and an image forming apparatus having used the electron source, and moreover the manufacturing method thereof.

In addition, the purpose of the present invention is to provide a substrate for forming an electron source in which dispersion of electron emission features between a plurality of electron emission devices is reduced, and the manufacturing method thereof.

In addition, the purpose of the present invention is to provide an electron source in which dispersion of electron emission features between a plurality of electron emission devices has been reduced, and an image forming apparatus having used the electron source, and moreover the manufacturing method thereof.

In order to achieve the above purpose, according to the present invention, a substrate for forming electron source in which an electron emission device is disposed comprises: a substrate containing Na; a first layer with $SiO_2$ as a main component having been formed on the substrate; and a second layer containing electron conductive oxide.

Further, according to the present invention, in a manufacturing method of a substrate for forming electron source with which an electron emission device is formed, a first layer with $SiO_2$ as its main component, and a second layer containing electron conductive oxide are formed on a substrate containing Na.

BRIEF DESCRIPTION OF THE DRAWINGS

FIG. 3A is a plan view and FIG. 3B is a sectional view;

FIG. 4A is a plan view and FIG. 4B is a sectional view;

FIG. 5A is a plan view and FIG. 5B is a sectional view;

FIG. 6A is a plan view and FIG. 6B is a sectional view;

DETAILED DESCRIPTION OF THE PREFERRED EMBODIMENTS

The present invention will be described further in details as follows.

In the present invention, the substrate in which a first layer with $SiO_2$ as the major component and a second layer containing electron conductive oxide are formed encompasses all substrates containing Na, but is a glass substrate containing $SiO_2$ occupying 50 to 75 weight percentage, and Na occupying 2 to 17 weight percentage, as a major component.

In addition, in the present invention, the above-described first layer and the above-described second layer include both of cases that at first the first layer has been formed on the above-described substrate containing Na, and in succession the second layer has been formed on the first layer and that at first the second layer has been formed on the above-described substrate containing Na, and in succession the first layer has been formed on the second layer.

In addition, in the present invention, electron conductivity refers to ion conductivity, and provision of a layer containing electron conductive materials has following advantages.

That is, with a substrate containing electron conductive materials being provided to the substrate, the substrate surface will show electric conductivity and unstability can be controlled due to charge-up during driving. Usage of ion conductive materials for the purpose of obtaining this electric conductivity may give rise to unstability in electron source features due to segregation of ions as a result of movement of ions while a voltage is applied for a long time period when a voltage related to driving is applied. This is considered to take place since a long time period is required for the movement of ions and thus the movement of ions between pulses, that is, at the time of a halt, is not completely restored, for example, in the case where, in relation to driving, a pulse-shaped voltage is applied. Such segregation of ions affect electron source features. Accordingly, in the case where as in the present invention the substrate comprises a layer containing electron conductive materials, and the conduction is implemented mainly by electron conduction, segregation of ions scarcely takes place, it is possible to avoid any influence to be given to the above-described electron source features.

Figure 1:
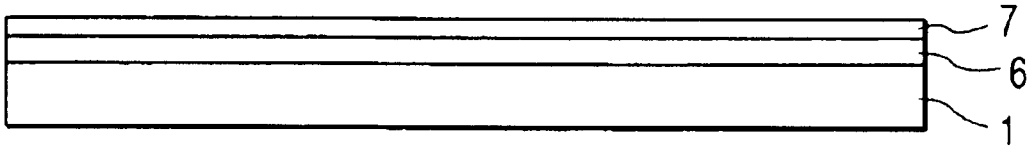
FIG. 1 is a schematic sectional view showing an example of a substrate for forming an electron source of the present invention.

Now, with reference to the drawings the preferred embodiments of the present invention will be described as follows. First, FIG. 1 is a sectional view showing a first embodiment of a substrate for forming an electron source. A substrate, such as a blue glass containing Na, or glass with high strain point in which a portion of Na have been replaced with K and distortion point has been heightened, or the like is numbered as 1, a first layer with $SiO_2$ being as the main component is numbered as 6, a second layer containing electron conductive oxide having been formed on the first layer is numbered as 7.

Here, in the substrate for forming an electron source of the present embodiment having been shown in FIG. 1, the electron emission device is formed on the second layer 7. Under the circumstances, the first layer 6 with $SiO_2$ as the main component is a layer provided mainly for the purpose of blocking diffusion of Na into members configuring the electron emission device, and as having been shown in FIG. 1, is formed on the substrate 1 containing Na so as to give rise to an effect to control diffusion of Na from the substrate 1. The thickness of the first layer 6 is preferably set at 300 nm or more on the point of view of controlling the above-described diffusion of Na, and moreover is especially preferably set at not more than 3 $\mu$m on the point of view of preventing occurrence of cracks or film stripping due to film's stress. In addition, it is preferable that at least one or more kinds of element among P, B, and Ge should be added to the first layer since the film stress of the first layer can be relieved and thus without giving rise to the above-described occurrence of cracks or film stripping due to film's stress the first layer can be formed comparatively thicker.

In addition, the second layer 7 is a layer which contains electron conductive oxide and has been provided for the purpose of preventing charging on the substrate surface where the electron emission device is formed. Showing electron conductivity, this second layer 7 can control charge-up of the substrate surface and make obtainable a stable electron emission features of the electron emission device to be disposed on the second layer 7. Film thickness of the second layer 7 is not regulated in particular, but it is especially preferable for obtaining the more sufficient above-described effect that the sheet resistance value of the substrate surface is set at within a range of $10^8$ Ω/□ to $10^{13}$ Ω/□. In addition, the electron conductive oxide to be contained in the second layer 7 is oxide fine particles of elements of at least one kind to be selected from Fe, Ni, Cu, Pd, Ir, In, Sn, Sb, and Re, for example. In addition, since the first layer 6 being the lower layer is a layer with $SiO_2$ as the main component, it is preferable that this second layer 7 is also a layer with $SiO_2$ as the main component.

Figure 2:
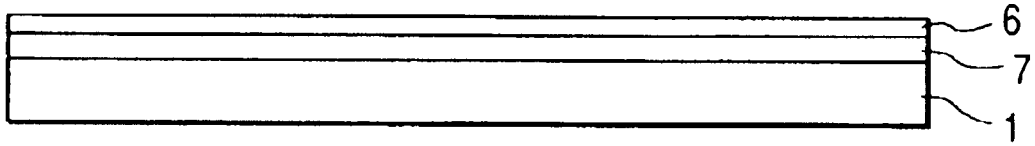
FIG. 2 is a schematic sectional view showing another example of a substrate for forming an electron source of the present invention.

Next, FIG. 2 is a sectional view showing a second embodiment of the substrate for forming an electron source. In the present embodiment, the order of lamination for the first layer 6 and the second layer 7 in the above-described first embodiment is different, and as shown in FIG. 2, the first layer 6 has been formed on the second layer having been formed on the substrate 1.

In FIG. 2, a substrate of a soda-lime glass, for example, containing Na, or of high strain point glass, which distortion point has been raised with a part of Na having been replaced with K or the like is numbered as 1, a second layer containing electron conductive oxide having been formed on the substrate containing the Na is numbered as 7, and a first layer with $SiO_2$ as the main component having been formed on the second layer is numbered as 6.

First, the second layer 7 disposed on the substrate 1 containing Na is a layer which contains electron conductive oxide and has been provided for the purpose of preventing charging on the substrate surface where the electron emission device is formed. Showing electron conductivity, this second layer 7 can control charge-up of the substrate surface and make obtainable a stable electron emission features of the electron emission device to be disposed on the first layer 6 to be described later. Film thickness of the second layer 7 is not regulated in particular, but it is especially preferable for obtaining the more sufficient above-described effect that the sheet resistance value of the substrate surface is set at within a range of $10^8$ Ω/□ to $10^{13}$ Ω/□. In addition, the electron conductive oxide to be contained in the second layer 7 is, as in the above-described first embodiment, oxide fine particles of elements of at least one kind to be selected from Fe, Ni, Cu, Pd, Ir, In, Sn, Sb, and Re, for example. In addition, since the first layer 6 being the upper layer is, as described later, a layer with $SiO_2$ as the main component, it is preferable that this second layer 7 is also a layer with $SiO_2$ as the main component.

In addition, in the substrate for forming an electron source of the present embodiment, the electron emission device is formed on the first layer 6 to be formed on the above-described second layer 7. Under the circumstances, the first layer 6 with $SiO_2$ as the main component is a layer provided mainly for the purpose of blocking diffusion of Na into members configuring the electron emission device, and as having been shown in FIG. 2, is formed on the second layer 7 on the substrate 1 containing Na so as to give rise to an effect to control diffusion of Na from the substrate 1. As compared with the above-described first embodiment, the thickness of the first layer 6 can be formed thinner if only low density Na having approached subject to diffusion through the second layer 7 from the substrate 1 should be blocked, but is preferably set at 50 nm or more on the point of view of controlling the above-described diffusion of Na, and moreover on the point of view of reducing uneveness on the substrate surface, where the electron emission device is disposed, due to oxide fine particles included in the above-described second layer 7. In addition, under the condition that the sheet resistance value on the substrate surface where the electron emission device is disposed falls within the above-described preferable range, thickness of the first layer 6 is especially preferably set at not more than 300 nm. In addition, it is preferable that at least one or more kinds of element among P, B, and Ge should be added, as in the above-described first embodiment, to the first layer since the film stress of the first layer can be relieved and thus without giving rise to the above-described occurrence of cracks or film stripping due to film's stress the first layer can be formed comparatively thicker.

Next, by using FIGS. 3A and 3B and FIGS. 4A and 4B, embodiments of an electron source utilizing the above-described substrate for forming an electron source are described.

Figure 3A:
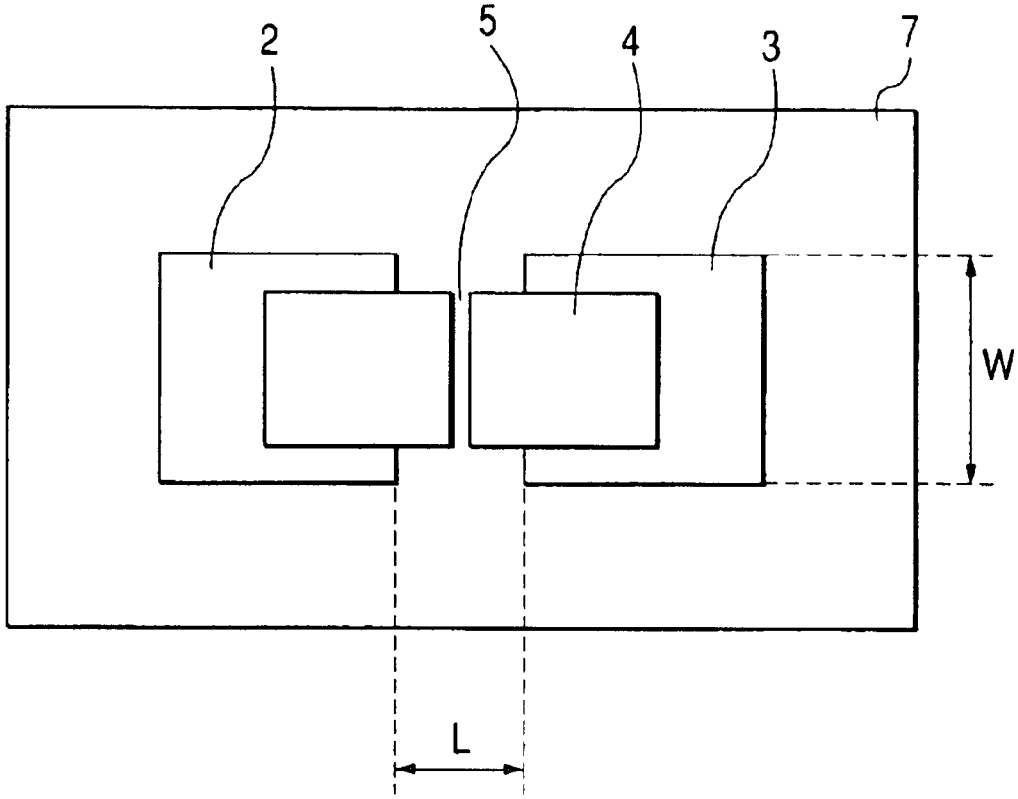
FIGS. 3A and 3B are schematic views showing an example of an electron source of the present invention.
Figure 3B:
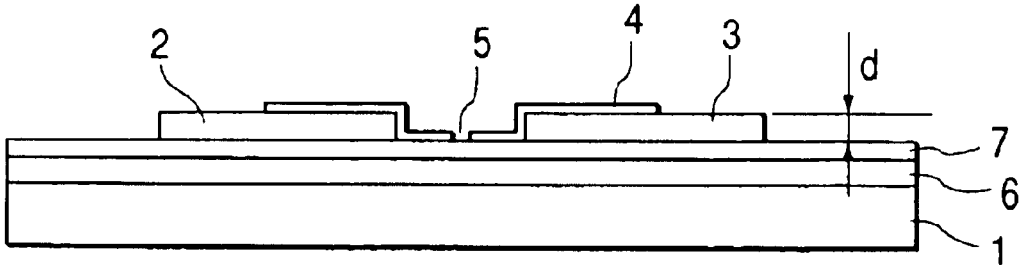

First, FIGS. 3A and 3B are schematic views showing the first embodiment of the electron source, and the FIG. 3A is a plan view, and the FIG. 3B is a sectional view. The electron source of the present embodiment is an electron source which has been configured using the substrate for forming an electron source having been shown in FIG. 1, and in FIGS. 3A and 3B, the above-described, substrate containing Na, first layer with $SiO_2$ as the main component, and second layer containing electron conductive oxide are respectively numbered as 1, 6, and 7. In the electron source of the present embodiment, the electron emission device has been disposed on the second layer 7. Here, the electron emission device, for example, is an electron emission device comprising a pair of electrodes and a conductive film having an electron emitting region and disposed between the pair of electrodes, and in the present embodiment, as shown in FIGS. 3A and 3B, a surface conduction electron emission device comprises a pair of conductive films 4 having been disposed across the gap 5 and a pair of element electrodes 2 and 3 having been electrically connected with the pair of conductive films 4 respectively has been used. Incidentally, the surface conduction electron emission device shown in FIGS. 3A and 3B is preferably an element of a mode comprising a carbon film on the conductive film 4.

Figure 4A:
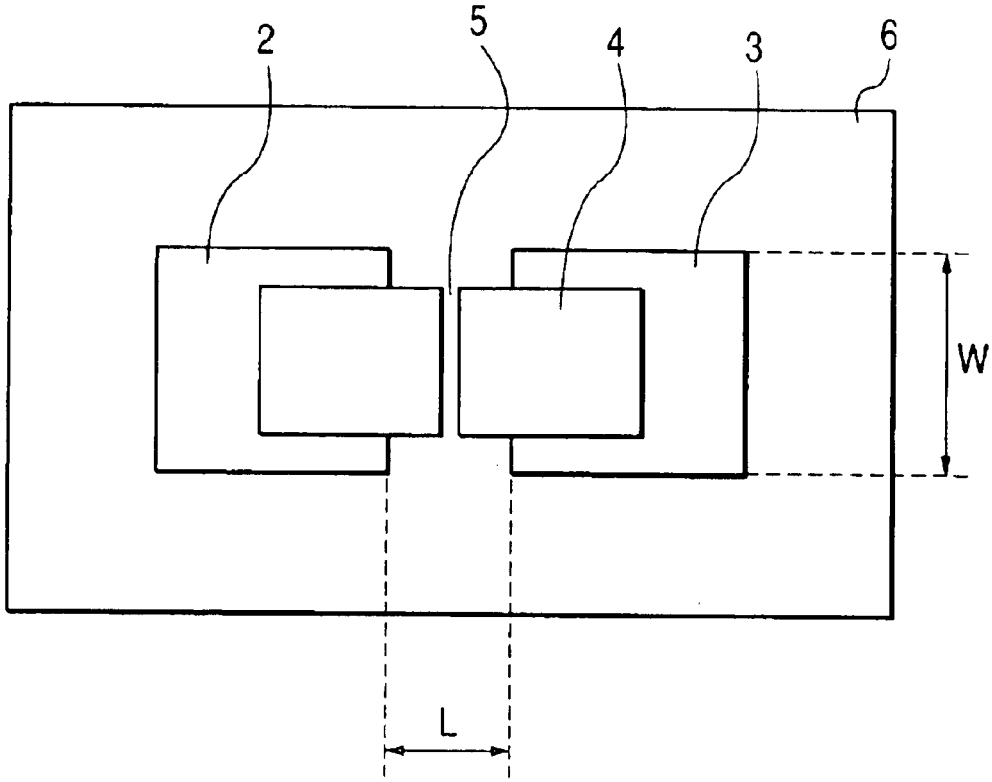
FIGS. 4A and 4B are schematic views showing another example of an electron source of the present invention.
Figure 4B:
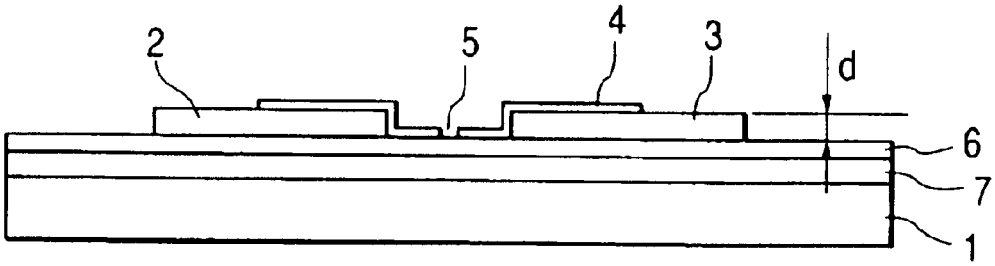

In addition, FIGS. 4A and 4B are schematic views showing the second embodiment of the electron source, and FIG. 4A is a plan view, and FIG. 4B is a sectional view. The electron source of the present embodiment is an electron source which has been configured using the substrate for forming an electron source having been shown in FIG. 2, and in FIGS. 4A and 4B, the above-described, substrate containing Na, first layer with $SiO_2$ as the main component, and second layer containing electron conductive oxide are respectively numbered as 1, 6, and 7. In the electron source of the present embodiment, the electron emission device has been disposed on the first layer 6, and also the electron emission device in the present embodiment is an element similar to the electron source of the first embodiment having been shown in FIGS. 3A and 3B.

Here, the surface conduction electron emission device which has been used in the first and the second embodiments of the electron source will be described in detail as follows.

At first, as materials for the facing element electrodes 2 and 3, common conductive materials can be used, and can be appropriately selected from, for example, metal or alloy of Ni, Cr, Au, Mo, W, Pt, Ti, Al, Cu, and Pd, etc. or printing conductor comprising metal such as Pd, Ag, Au, $RuO_2$, and Pd—Ag, etc. or metal oxide and glass, etc., or transparent electric conductor such as $In_2O_3$_$SnO_2$, etc., or conductive materials for semiconductor such as polysilicon or the like.

In addition, as materials comprising the conductive film 4 can be appropriately selected from metals such as Pd, Pt, Ru, Ag, Au, Ti, ln, Cu, Cr, Fe, Zn, Sn, Ta, W, and Pd, etc., oxice such as PdO, $SnO_2$, $In_2O_3$, PbO, $SbO_3$, etc.

The conductive film 4 is preferably a particle film having been configured by a plurality of fine particles having the particle diameter within the range of 1 nm to 20 nm so as to obtain good electron emission features. In addition, thickness of the conductive film 4 is preferably set to fall within the range of 1 nm to 50 nm.

In addition, the gap 5 is formed, for example, by forming a crack to the conductive film having been formed across the element electrodes 2 and 3 with the forming processing to be mentioned later.

In addition, as described above, on the conductive film 4, a carbon film is preferably formed on the point of view of improvement of electron emission features and reduction of changes according to lapse of time of electron emission features.

Figure 5A:
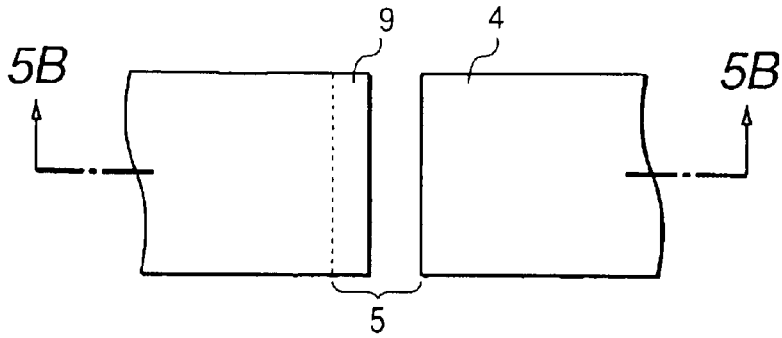
FIGS. 5A and 5B show a partially enlarged portion of an example of the surface conduction electron emission device which are applied to the electron source of the present invention.
Figure 5B:
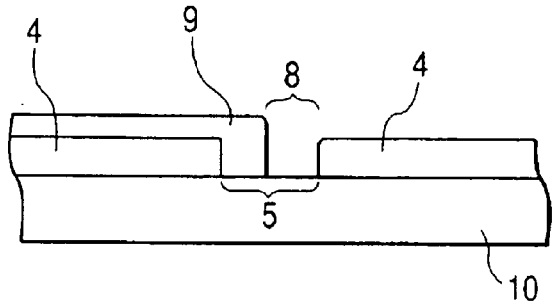
Figure 6A:
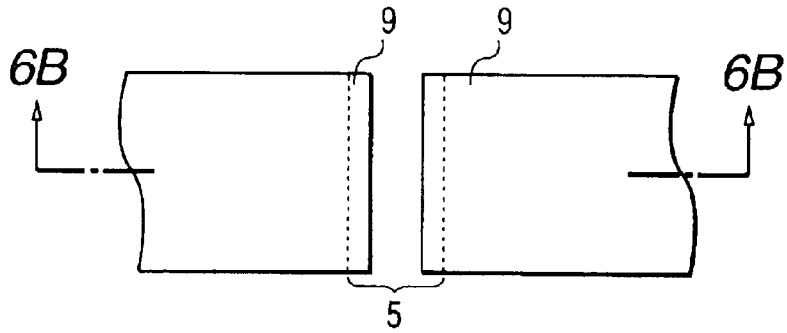
FIGS. 6A and 6B show a partially enlarged portion of another example of the surface conduction electron emission device which are applied to the electron source of the present invention.
Figure 6B:
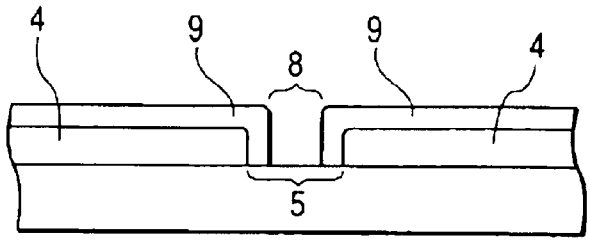

This carbon film is formed, for example, as shown in FIGS. 5A and 5B. Here, FIG. 5A is a schematic plan view in which the portion in the vicinity of the gap of conductive film of the surface conduction electron emission device comprising a carbon film has been enlarged, and FIG. 5B is 5B—5B section view thereof. As shown in FIGS. 5A and 5B, the surface conduction electron emission device comprising the carbon film is connected with a conductive film 4 so as to form a gap 8 narrower than a gap 5 formed by the above described pair of conductive film 4 and comprises a carbon film 9 on the substrate 10 within the gap 5 as well as on the conductive film 4. In addition, as shown in FIGS. 6A and 6B, for a mode in which the both ends of the pair of conductive film 4 facing the gap 5 comprise the carbon film 9 as mentioned in the above an effect as mentioned above is obtained.

Next, with reference to FIGS. 7A to 7D, an example of manufacturing method of the above-described electron source shown in FIGS. 3A and 3B will be explained.

1) The substrate 1, which contains Na, such as a blue glass and glass with a high strain point, etc. is sufficiently cleaned with detergent, pure water, and organic solvent, etc., and the first layer 6 is formed on such a substrate 1. Here, as the forming method of the first layer 6, the physical film forming methods such as the sputtering method, and the vacuum evaporation method, etc. can be used, but the chemical deposition method is preferably used. Chemical deposition method is a method to form films by using chemicals (starting materials) containing that film-forming element via chemical reaction, and burning processing of organic chemical compounds, and CVD method, etc. are commonly known. These methods give rise to advantages such as that a thick film can be obtained comparatively easily, and the uneven surface can be flattened. As the starting materials of the first layer 6, silicon chemical compounds being as their main components are used, and phosphorus compounds, boron compounds, germanium compounds are added to or simultaneously introduced into those silicon chemical compounds, and thus the above-described layer to which P, B, and Ge have been added can be formed.

Subsequently, on this first layer 6 the second layer 7 is formed.

Here, as the forming method of the second layer 7, the above-described physical film forming method and particle distributing application method, etc. may be used, and the same chemical deposition method as in the forming method of the first layer 6 is preferably used since the above-described first layer 6 can be followed by forming thereof in a successive manner. For example, the first layer 6 is film-formed with CVD method with silicon compounds as its starting material, and in succession, the above-described silicon compounds being switched with the source of chemical compound to become an electron conductive oxide as the starting material, the second layer 7 can be film-formed in a successive manner. In addition, it gives rise to shortening of activation processing time and improvement in electron emission features as a result of promotion of activation to be described later especially in the case where the electron emission device is a surface conduction electron emission device that the first layer 6 is film-formed with CVD method with silicon compounds as its starting material, and in succession, the source of chemical compound to become an electron conductive oxide as the starting material being introduced in addition to the above-described silicon compounds, the second layer 7 is film-formed in a successive manner since $SiO_2$ is contained in the second layer 7 on the surface of which the electron emission device is formed. In addition, also when the electron conductive oxide to be contained in the second layer 7 is among others an oxide containing at least one kind of elements of In, Sn, Sb and Re, In, Sn, Sb, and Re have the effect of promotion of the above-described activation so as to obtain an effect as mentioned above.

Figure 7A:
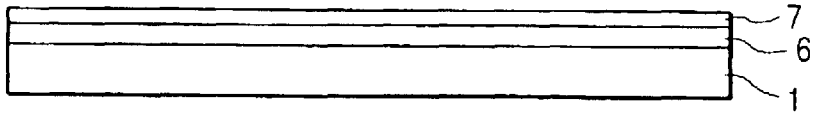
FIGS. 7A, 7B, 7C and 7D are schematic views describing the manufacturing procedure of an electron source related to the present invention.

As mentioned so far, the substrate for forming an electron source having configuration that the first layer 6 and the second layer 7 are laminated in this order on the substrate 1 is formed (FIG. 7A).

Next, on the above-described substrate for forming electron source the electron emission device, or among others the surface conduction electron emission device is formed.

Figure 7B:
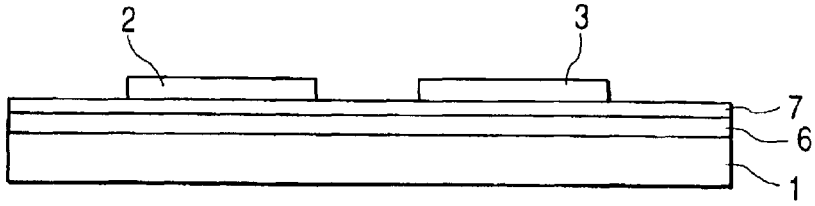

2) After the element electrode material is deposited with vacuum evaporation method, and sputtering method, etc., the element electrodes 2 and 3 are formed on the surface of the second layer 7 by using for example photolithography technology (FIG. 7B).

Figure 7C:
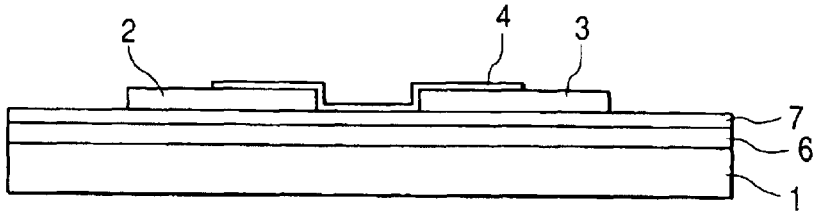

3) The organic metal film is formed on the second layer 7, which has been provided with the element electrodes 2 and 3, and to which organic metal solution is applied. For the organic metal solution, an organic metal compound solution with material metal for said conductive film 4 as the main elements can be used. The organic metal film undergoes heating and burning processing, and undergoes patterning by liftoff, and etching, etc., and the conductive film 4 is formed (FIG. 7C). Here, the application method of organic metal solution has been nominated for description, but the forming method of the conductive film 4 is not limited to this, but vacuum evaporation method, sputtering method, chemical vapor depositing method, scattered application method, dipping method, spinner method, etc. can be used.

Figure 7D:
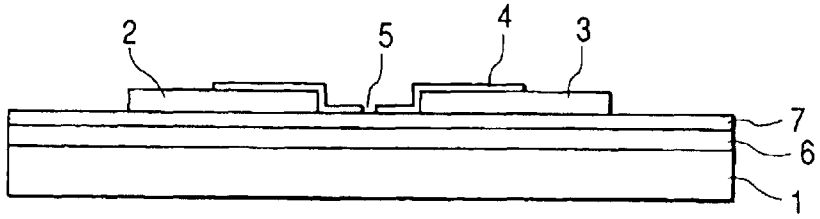

4) In succession, forming process is implemented. As an example of process of this forming method, the method by way of electroprocessing is explained. A not-shown power source is used between the element electrodes 2 and 3 so as to implement conduction, then the gap 5 is formed in the conductive film 4 (FIG. 7D). The voltage wave form of energization forming is exemplified in FIGS. 8A and 8B.

As the voltage wave form, pulse wave forms are preferable. This includes technique to apply pulse with pulse height value of a constant voltage on continuous basis as having shown in FIG. 8A, and technique to apply voltage pulses while increasing pulse height value as having shown in FIG. 8B.

Figure 8A:
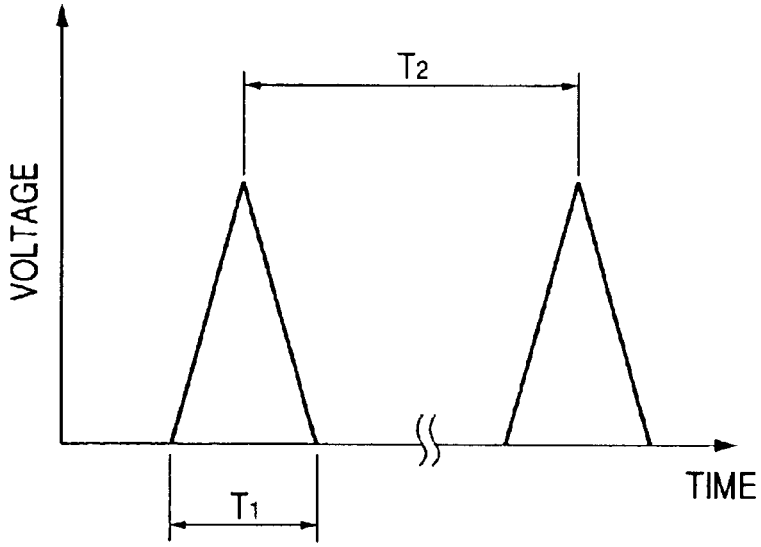
FIGS. 8A and 8B are schematic views describing the pulse voltage wave form to be used in the forming of an electron source related to the present invention.

T1 and T2 in FIG. 8A is the pulse width and the pulse interval of a voltage wave form. Normally T1 is from 1 μsec to 10 msec, and T2 is set to fall within the range from 10 μsec to 10 msec. The wave height value of the triangular wave (the peak voltage at the time of energization forming) is appropriately selected in accordance with the mode of the electron emission device. Under such conditions, voltage is applied for the period of for example from several seconds to several ten minutes. The pulse wave form is not limited to triangular wave, but desired wave forms such as rectangular wave can be adopted.

Figure 8B:
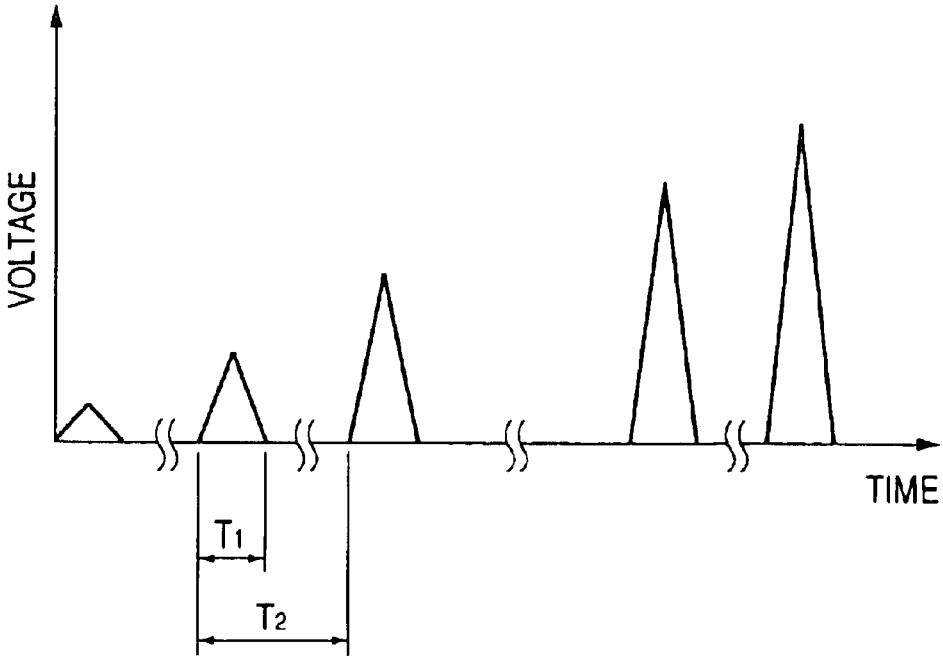

T1 and T2 in FIG. 8B can be those shown in FIG. 8A. The wave height value of triangular wave (the peak voltage at the time of energization forming) can be increased, for example, approximately every 0.1 V step. As concerns the conclusion of conductive forming processing, for example, measuring the element current which flows when a voltage around 0.1V is applied within the pulse interval T2 and obtaining the resistant values, and when resistant not less than 1 MΩ is indicated, conductive forming is concluded.

5) It is preferable to implement processing called activation process onto the element which has undergone forming. The activation process is a process in which due to this process, the element current If and the electron emission current Ie incur remarkable changes. The activation process can be implemented, for example, under the atmosphere containing organic gas substances with a pulse voltage being repeatedly applied as in the conductive forming. This atmosphere can be formed using organic gas remaining in the atmosphere when internal gas of the vacuum container has been ventilated with for example an oil diffusion pump or a rotary pump, etc., or otherwise this atmosphere can also be obtained by introducing gas of suitable organic substances into vacuum where ions for example have been once removed to a sufficient extent. The preferred gas pressure of the organic substances at this time is appropriately set on a case-by-case basis since it depends on said application mode, the shape of vacuum container and the kind of organic substances, etc. As suitable organic substances, alkane, alkene, aliphatic hydrocarbons of alkane, aromatic hydrocarbon, alcohols, aldehydes, ketones, amines, phenol, carvone, organic acids, etc. of sulfonic acid, or the like, can be nominated, and, in particular, methane, ethane, propane, and other saturated hydrocarbon represented by $C_nH_{2n+2}$, ethylene, propylene, and other unsaturated hydrocarbon represented by composition formula such as $C_nH_{2n}$, etc., benzene, toluene, methanol, ethanol, formaldehyde, acetaldehyde, acetone, methyl ethyl ketone, methylamine, ethylamine, phenol, formic acid, acetic acid, propionic acid, etc. or mixture thereof can be used. This processing will cause a carbon film to deposit on the element from organic substances existing in the atmosphere, and will cause the element current If and the emission current Ie to undergo remarkable changes.

The conclusion of the activation process is appropriately determined while the element current If and the emission current Ie are being measured. Incidentally, the pulse width, the pulse interval, the pulse wave height value, etc. are appropriately set.

The above-described carbon film is a film of, for example, graphite (inclusive of so-called HOPG, PG, and GC, and HOPG has an almost complete crystal configuration of graphite, PG is referred to those with a little bit disturbed crystal configuration by crystal particle being sized around 20 nm, and GC is referred to those with a further disturbed crystal configuration with crystal particle being sized around 2 nm), or non-crystal quality carbon (amorphous carbon and mixture of amorphous carbon and a mixture of the minute crystal of said graphite are referred to), and its film thickness is preferably set to fall within the range of not more than 50 nm and more preferably not more than 30 nm.

As described so far, the electron source shown in FIGS. 3A and 3B is manufactured.

Next, an example of manufacturing method of the electron source having been shown in FIGS. 4A and 4B will be described below.

1) The substrate 1 made of substrate containing Na such as soda-lime glass and high strain point glass, etc. is sufficiently cleaned with detergent, pure water, and organic solvent, etc., and the second layer 7 is formed on such substrate 1 and the first layer 6 is formed on the second layer in succession respectively according to the following procedure. At first, the above-described electron conductive oxide fine particles are applied onto the substrate 1 in a scattered manner. At this time, a silicon compound may be mixed into the above-mentioned scattered solution so as to form the above-described second layer 7 with $SiO_2$ as a main component. Subsequently, after the above-mentioned scattered solvent has been dried, a silicon compound as a starting raw material for the first layer 6, such as a solution containing organic silicon is applied thereon. At this time, phosphorus compounds, boron compounds, or germaium compounds may be added to the above-mentioned silicon compound being the starting raw material of the first layer 6 so as to form the above-described first layer 6 to which P, B, or Ge has been added. Thereafter, the whole substrate 1 undergoes heating and burning in an oven so as to form the second layer 7 and the first layer 6 on the substrate 1. This technique is preferably used since there is uneveness on the surface of the second layer 7 containing oxide fine particles and thus by further forming the first layer 6 with the above-mentioned method the surface of the substrate for forming electron source is made comparatively flattened to make forming of an electron emission device easier. In addition, such uneveness might cause a cut due to step difference in the case where the electron emission device comprises a film-shaped conductive member (conductive film) as in the surface conduction electron emission device, the above-mentioned first layer 6 is more preferably provided. In addition, since the fist layer 6 comprises $SiO_2$ as its main component, aforementioned promotion of activation of a surface conduction electron emission device, shortening of activation processing time is promoted and improvement in electron emission features is implemented.

As described so far, a substrate for forming electron source in which the second layer 7 and the first layer 6 are laminated on the substrate 1 in this order is formed.

Next, an electron emission device or, among others, a surface conductive type electron emission device is formed on the above-mentioned substrate for forming electron source. This surface conductive type electron emission device is formed with the method as mentioned above.

As another embodiment of the electron source having been formed by using the substrate for forming electron source as described so far, examples of an electron source in which a plurality of the electron emission devices are arranged and an image forming apparatus by using the electron source are described below.

Figure 9:
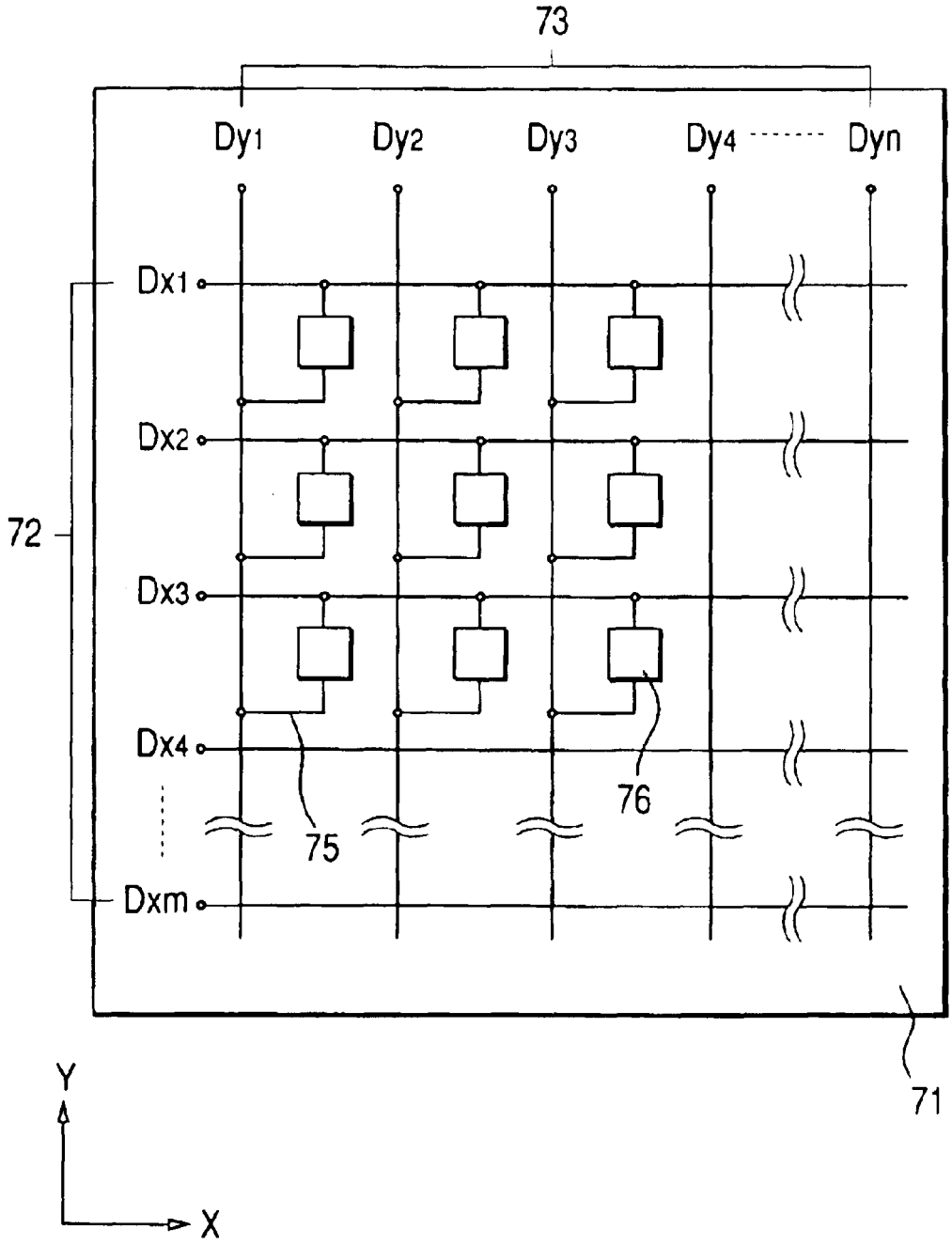
FIG. 9 is a schematic view showing a configuration of an electron source of the present invention.

FIG. 9 is a schematic view showing an electron source in which a plurality of electron emission devices are matrix-wired on the substrate for forming electron source shown in FIG. 1 or FIG. 2. In FIG. 9, a substrate is numbered as 71 and the above-described first layer and the second layer have been provided in advance. Wiring in the row direction is numbered as 72, and wiring in the column direction is numbered as 73. The electron emission device is numbered as 76, and wiring knot is numbered as 75.

The row direction wiring 72 in m units comprises Dx1, Dx2, . . . , Dxm, and can be configured by conductive metal formed by using vacuum evaporation method, printing method, and sputtering method, etc. or the like. The column direction wiring 73 comprises wiring of n units, namely Dy1, Dy2, . . . , and Dyn, and is formed similarly to the row direction wiring 72. Although not shown, an inter-layer insulation layer is provided between these m units of the row direction wiring 72 and n units of the column direction wiring 73 to electrically separate the both parties (m and n are both positive integral numbers).

The inter-layer insulation layer is configured by $SiO_2$ formed by using vacuum evaporation method, printing method, and sputtering method, etc. or the like. For example, the layer is formed into a desired shape on the entire surface or on a portion of the electron source substrate 71 having formed the column direction wiring 73, and film thickness, material, and, producing method are appropriately set so that especially the layer can tolerate the potential at the intersection between the row direction wiring 72 and the column direction wiring 73. The row direction wiring 72 and the column direction wiring 73 are respectively pulled out as external terminals.

The electron emission devices 76 are electrically connected with m units of the row direction wiring 72, and n units of the column direction wiring 73 with the wiring knot 75 made of conductive metal, etc.

The row direction wiring 72 is connected with the not shown scanning signal application means which applies the scanning signal to select lines of electron emission devices 74 arranged in the X direction. On the other hand, the column direction wiring 73 is connected with the not-shown modulated signal generating means for modulating each column of the electron emission devices 74 arranged in the Y direction in accordance with the input signals. The driving voltage which is applied to each electron emission device is supplied as differential voltage between the scanning signal and the modulated signal to be applied to the element.

In the above-described configuration, simple matrix wiring is used to enable respective elements to be selected independently and to drive independently.

Figure 10:
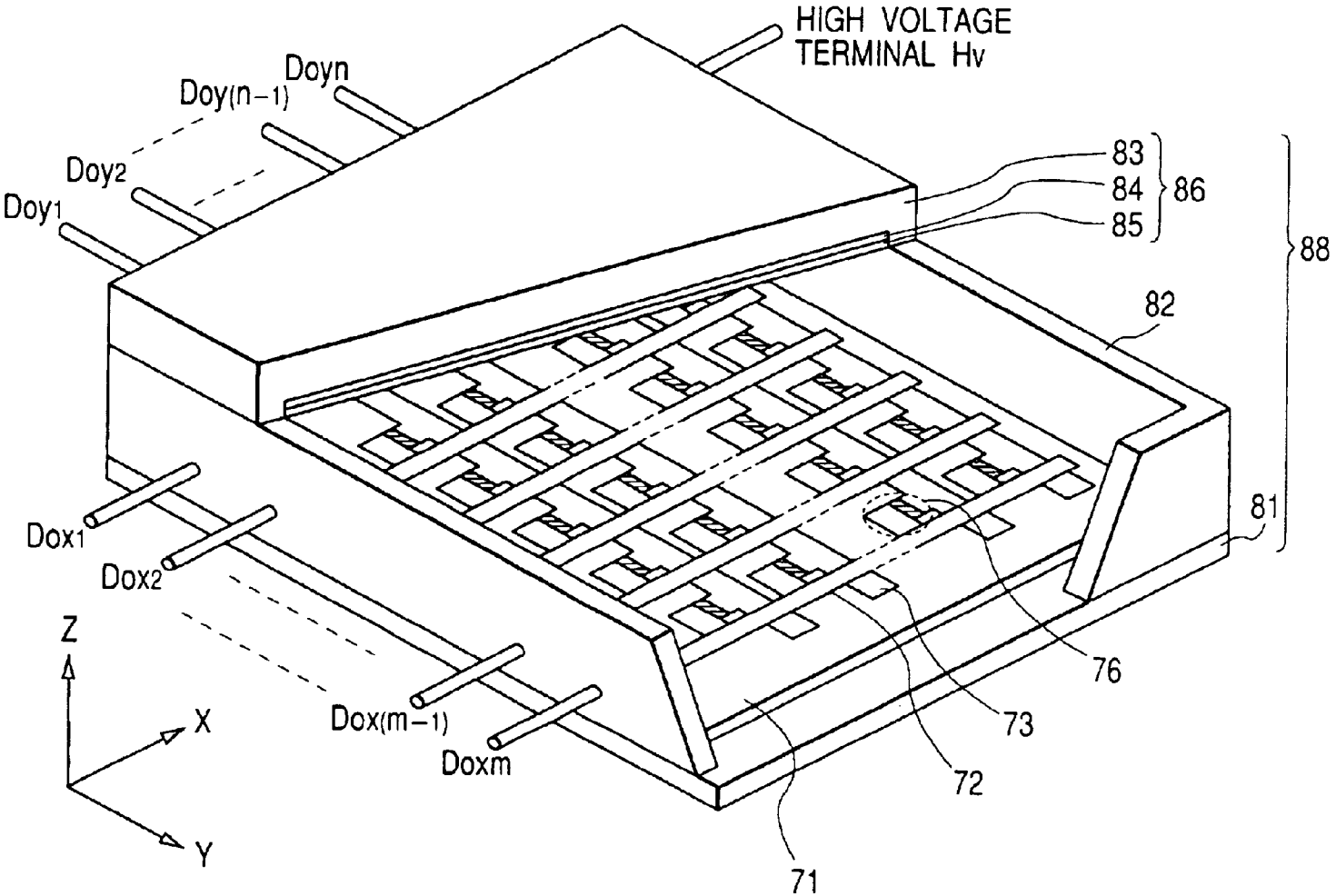
FIG. 10 is a schematic view showing a configuration of an image forming apparatus of the present invention.
Figure 11A:
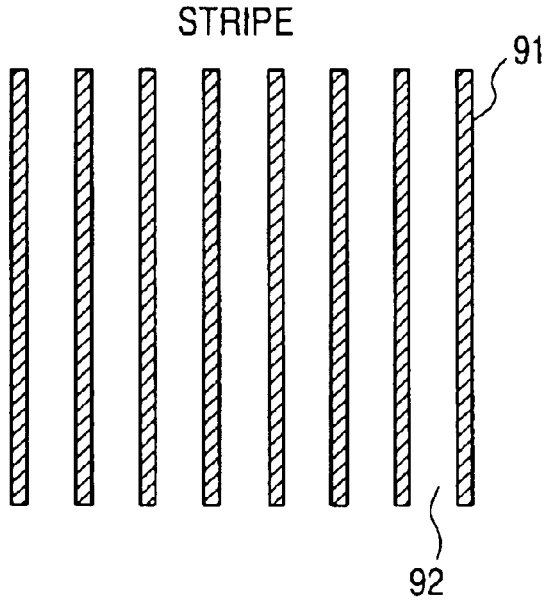
FIGS. 11A and 11B are schematic views showing a configuration of a fluorescent film to be used in an image forming apparatus of the present invention.
Figure 11B:
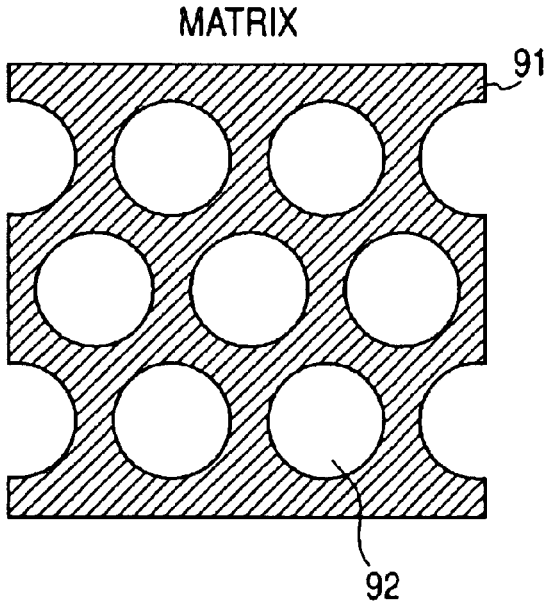
Figure 12:
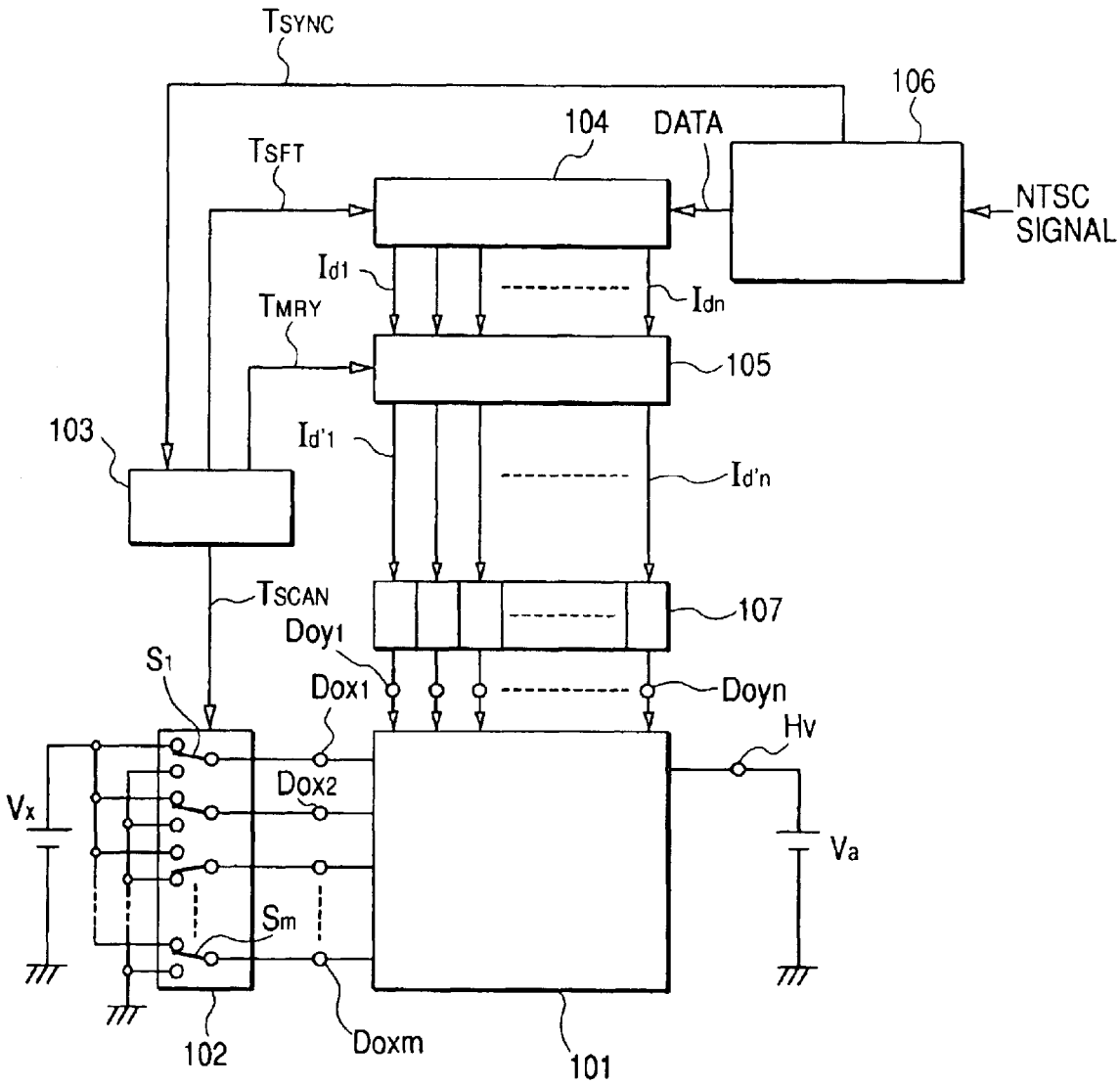
FIG. 12 is a block diagram showing an example of the drive circuit.

By using FIG. 10, FIGS. 11A and 11B, and FIG. 12, described is an image forming apparatus which has be configured by usage of an electron source in which a plurality of the surface conduction electron emission devices are simply matrix-wired on the above-described substrate for forming electron source, by using surface conduction electron emission devices as the above-mentioned electron emission device. FIG. 10 is a schematic view showing one example of the display panel of an image forming apparatus, and FIGS. 11A and 11B are schematic views of fluorescent film used for the image forming apparatus in FIG. 10. FIG. 12 is a block diagram showing one example of driving circuit to implement display in accordance with television signals of the NTSC system.

In FIG. 10, the substrate, shown in FIG. 1 or FIG. 2 described above, in which plurality of surface conduction electron emission devices 76 are disposed is numbered as 71, a rear plate on which the substrate 71 is fixed is numbered as 81, and the face plate in which fluorescent film 84 and metal back 85, etc. are formed inside the glass substrate 83 is numbered as 86. A supporting frame is numbered as 82 and to the supporting frame 82 a rear plate 81 and face plate 86 have undergone junction using flit glass with low melting point or the like.

The row direction wiring and the column direction wiring connected with the surface conduction electron emission device 76 are respectively numbered as 72 and 73.

The exterior enclosure 88 is configured by comprising a face plate 86, a supporting 82 and a rear plate 81 as described above. Since the rear plate 81 is mainly provided for the purpose of reinforcing strength of the substrate 71, and thus when the substrate 71 itself has sufficient strength, a rear plate 81 as a separate body can be regarded unnecessary. That is, the supporting frame 82 is directly sealed to the substrate 71 and the exterior enclosure 88 may be configured by the face plate 86, the supporting frame 82 and the substrate 71. On the other hand, a not-shown supporting body called a spacer can be disposed between the face plate 86 and the rear plate 81 to configure the exterior enclosure 88 with sufficient strength against the atmosphere pressure.

FIGS. 11A and 11B are schematic views showing a fluorescent film. The fluorescent film 84 can be configured by only phosphor body in the monochrome case. In case of color fluorescent film, the film can be configured by black conductive members 91 called black stripe or black matrix, etc. due to arrangement of phosphor and phosphor 92. The purpose of providing a black stripe and a black matrix is to lessen color mixture, etc. to an unnoticeable level by blackening the portions adjacent portions outside each phosphor 92 to which necessary three basic color fluorescent bodies are allocated in case of color display, and to control decrease in contrast due to reflection of outer lights in the fluorescent film 84. For the black stripe material, other than the material involving normally used graphite as a main component, materials which has conductivity, and less transparency and reflection of lights can be used.

The method to apply phosphor to a glass substrate is not limited to monochrome or color, and precipitation method and print processes, etc. can be adopted. Metal back 85 is normally provided on the interior surface of the fluorescent film 84. The purpose to provide a metal back is to improve brightness by causing lights toward the interior surface from radiation of the phosphor to mirror-reflect to direction of the face plate 86, and to cause to act as electrode to apply electron beam acceleration voltage, and to protect the phosphor against damage due to crashing of negative ions generated inside the exterior enclosure or the like. The metal back can be formed by implementing smoothing processing on the surface of interior party of the fluorescent film (normally called "filming") after the fluorescent film is formed, and thereafter depositing Al using vacuum evaporation method, etc.

The face plate 86 may be provided with a transparent electrode (not shown) to the exterior party of the fluorescent film 84 to further improve conductivity of the fluorescent film 84.

When said sealing is implemented, in the color case, each color phosphor is required to correspond with the electron emission device, and sufficient positioning will be indispensable.

Figure 13:
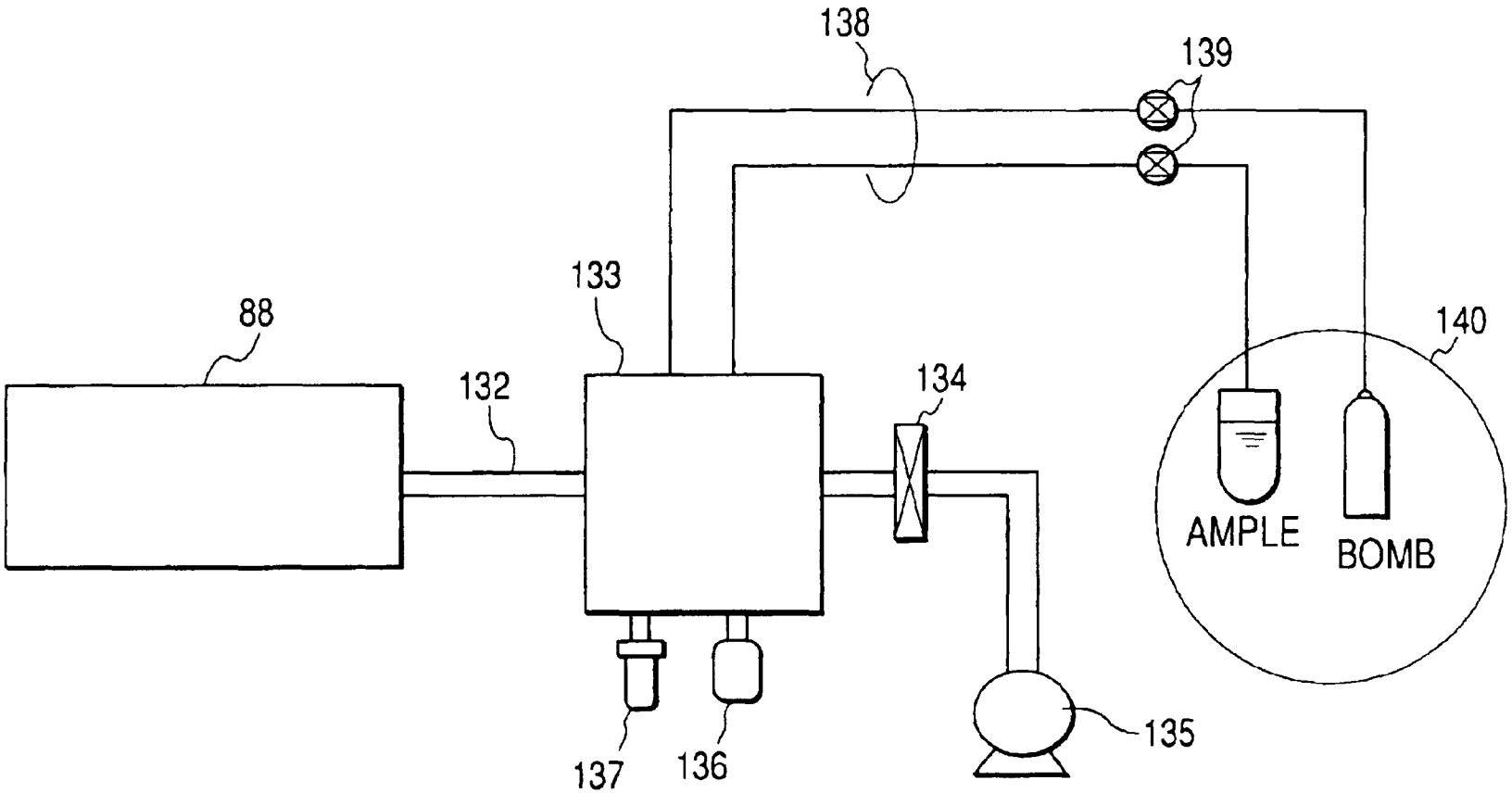
FIG. 13 is a schematic view outlining the device to be used in manufacturing an image forming apparatus.

One example of manufacturing method of an image forming apparatus shown in FIG. 10 will be described below. FIG. 13 is a schematic view showing outlines of the device to be used in this process. The exterior enclosure 88 is combined with the vacuum chamber 133 via ventilation tube 132, and moreover, is connected with the ventilation device 135 via the gate valve 134. To the vacuum chamber 133, a pressure measure 136 and quadrupole mass spectrograph 137, etc. are attached for the purpose of measuring the interior pressure as well as the pressure allocated to each component in the atmosphere. Since it is difficult to measure the interior pressure of the exterior enclosure 88, etc. directly, the pressure inside the vacuum chamber 133, etc. are measured so as to control the processing conditions. A gas introduction line 138 is connected with the vacuum chamber 133 to further introduce the necessary gas into the vacuum chamber and to control the atmosphere thereof. An introduction substance source 140, where the introduction substances have been put into and stored in an ample and a gas cylinder, is connected with the other end of the gas introduction line 138. In halfway of the gas introduction line, introduction controlling means 139 is provided for the purpose of controlling the introduction rate of introduction substances. As the introduction controlling means, in particular, a valve which can control the running-out flow, such as a slow leak valve, or mass flow controller, or the like are respectively usable in accordance with the kinds of introduction substances.

Figure 14:
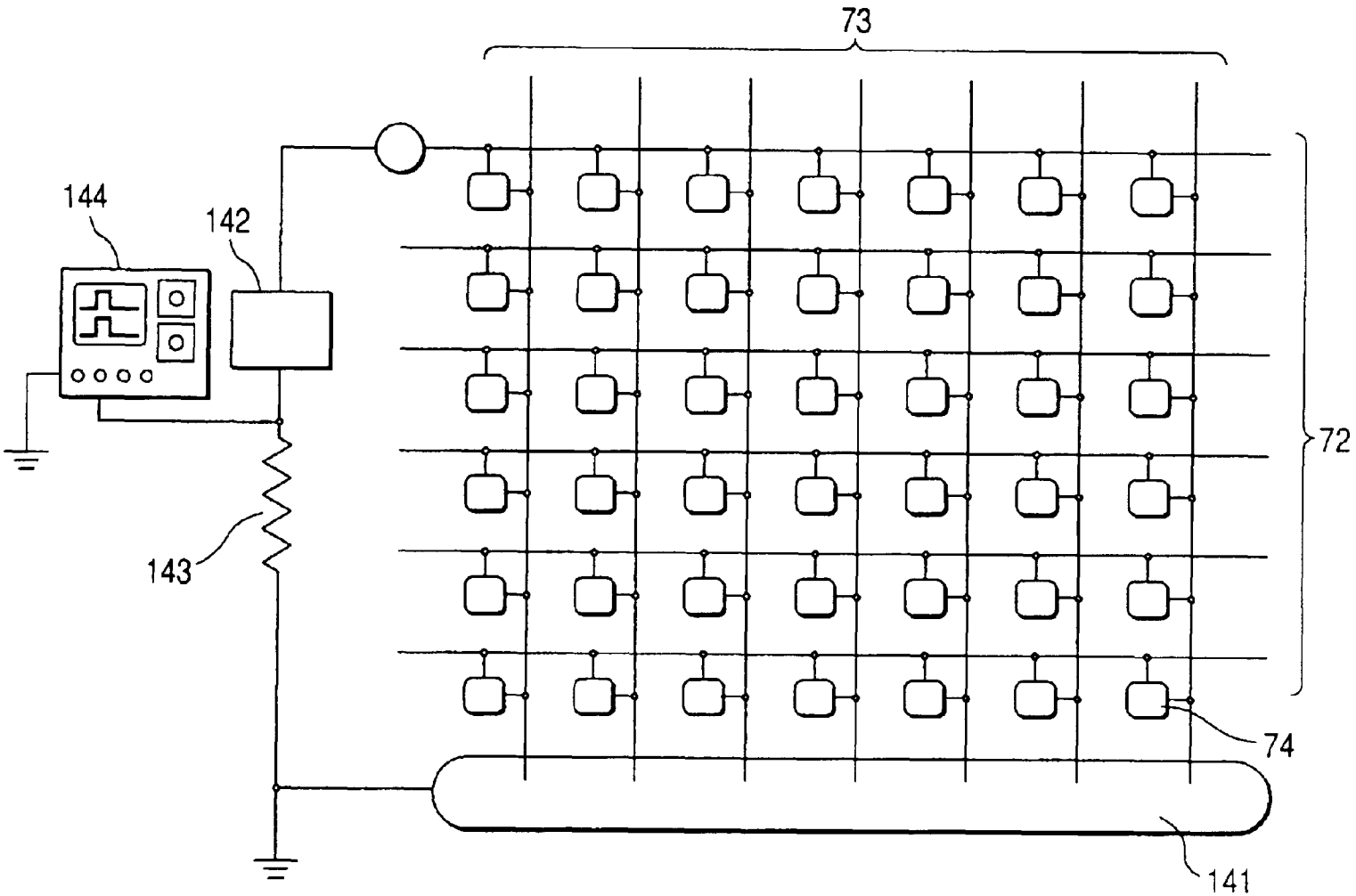
FIG. 14 is a schematic view showing a connection method for the forming process and the activation process of an image forming apparatus of the present invention.

With the device in FIG. 13, the interior of the enclosure 88 is ventilated to implement forming. In this occasion, as shown for example in FIG. 14, the column direction wiring 73 is connected with the common electrode 141, and voltage pulses are simultaneously applied to the elements having been connected with one of the row direction wiring 72, and thus forming can be implemented. Conditions such as the shape of a pulse, and determination on the conclusion of the processing, etc. may be selected in accordance with the already-described method on forming on an individual element. In addition, also by applying pulses in succession (scrolling) to a plurality of the row direction wiring with the phase having been staggered, the elements connected with a plurality of row direction wiring can undergo forming at a time. In the drawings, the resistance for measuring current is numbered as 143 and an oscilloscope for measuring current is numbered as 144.

After forming is over, the activation process is implemented. Into the enclosure 88, the interior gas of which has been sufficiently ventilated first the organic substances are introduced from the gas introduction line 138. Or, as an activation method on individual element, as described, at first, ventilation is implemented with an oil diffusion pump or a rotary pump, and thus the organic substances remaining in the vacuum atmosphere may be used. In addition, in accordance with necessity, substances other than organic substances could be introduced. Voltage being applied to each electron emission device in the atmosphere containing organic substances as formed in this way, carbon or carbon compounds or mixture of both parties are deposited on the electron emission device and the electron emission quantity is drastically increased as in case of an individual element. As concerns the application method of voltage at this time, the simultaneous voltage pulses may be applied to the elements which are connected with one row direction wiring by way of connection as in case of the above-described forming. In addition, also by applying pulses in succession (scrolling) to a plurality of the row direction wiring with the phase having been staggered, the elements connected with a plurality of row direction wiring can undergo activation at a time, and in that case, the activation processing is implemented so that the element current is controlled toward each row direction wiring, thus it will become possible that the element currents among the row direction wirings are made uniform. After the activation process is over, the stabilization unit is preferably implemented as in case of an individual element. The enclosure 88 is heated to maintain the temperature of 80 to 250° C., and ventilation is implemented through the ventilation tube 132 by the ventilation device 135 without using oil such as ion pump and absorption pump, etc. to sufficiently lessen organic substances from the atmosphere, and thereafter the ventilation tube is heated with a burner to melt, and sealed out. For the purpose of maintaining the pressure after sealing of the enclosure 88, getter processing can be implemented. This is a processing to heat the getter disposed in the predetermined position (not shown) inside the enclosure 88 by using resistance heating or high frequency heating, etc. just before the exterior enclosure 88 is sealed or after sealed, is heated and thus to form the evaporation film. The getter normally comprises Ba, etc. as its main component, and absorption function of the evaporation film serves to maintain the atmosphere inside the enclosure 88.

By using FIG. 12, described will be a configuration example of a driving circuit to implement television display based on television signals of the NTSC system onto the display panel configured by using the electron source of the simple matrix disposition. In FIG. 12, an image display panel is denoted as 101, a scanning circuit is denoted as 102, a controlling circuit is denoted as 103, and a shift register is denoted as 104. A line memory is denoted as 105, a synchronizing signal separation circuit is denoted as 106, a modulation signal generating circuit is denoted as 107, and Vx and Va are direct voltage source.

The display panel 101 is connected with an outside electric circuit via the terminals Dox1 through Doxm, the terminals Doy1 through Doyn, and the high voltage terminal Hv. Applied to the terminals Dox1 through Doxm is the scanning signal for driving in succession the electron source provided in the display panel, or a group of electron emission devices which are matrix-wired in a shape of rows and columns with M rows and N columns line by line (on N elements).

Applied to the terminals Dy1 through Dyn is a modulation signal for controlling the output electron beams from each element of a line of electron emission devices selected by said scanning signal. Supplied to the high voltage terminal Hv is a direct voltage of such as 10 kV from the direct voltage source Va, and this is an acceleration voltage to give to the electron beam to be emitted from the electron emission device the sufficient energy to excite the phosphor.

The scanning circuit 102 will be described. The circuit comprises M units of switching elements (which are shown as a schematic with S1 through Sm in the drawing) inside itself. Each switching element selects either of the output voltage of the direct voltage source Vx or 0V (the ground level), and is electrically connected with the terminals Dx1 thorough Dxm of the display panel 101. Each switching element of S1 through Sm is to operate based on the controlling signal Tscan which the controlling circuit 103 outputs, and can be configured by combining switching elements such as FET, for example.

In this example, based on the features of the electron emission device (electron emission threshold voltage), the direct voltage source Vx is set to output such a constant voltage that the driving voltage to be applied to the elements not yet scanned will be not more than the electron emission threshold voltage.

The controlling circuit 103 has a function to implement matching among each portions so that appropriate display may be implemented based on the image signal inputted from outside. Based on the synchronization signal Tsync to be sent from the synchronization signal separation circuit 106, the controlling circuit 103 generates controlling signals respectively of Tscan, Tsft and Tmry to each portion.

The synchronization signal separation circuit 106 is a circuit to separate the synchronization signal component and the brightness signal component from the television signals of the NTSC system to be inputted from outside. The synchronization signals separated by the synchronization signal separation circuit 106 comprise vertical synchronization signals and horizontal synchronization signals, and here for the descriptive convenience have been illustrated as Tsync signals. The image brightness signal component separated from said television signals has been represented as DATA signal for convenience sake. The DATA signal is inputted to the shift register 104.

The shift register 104 is to proceed with serial/parallel-converting on a line-by-line on the basis of images said DATA signals which are inputted serially in a timely arranged fashion, and to operate based on the controlling signals Tsft to be sent by said controlling circuit 103, (that is, the controlling signals Tsft can be referred to as a shift clock of the shift register 104). The data for a line of serial/parallel-converted image (equivalent to driving data for N-unit elements of the electron emission devices) is outputted from said shift register 104 as N-unit parallel signals of Id1 through Idn.

The line memory 105 is a memory device to memorize the data for a line of image for a necessary time period, and memorizes contents of Id1 through Idn appropriately in accordance with the controlling signals Tmry to be sent from the controlling circuit 103. The stored contents are outputted as I'd1 through I'dn, and inputted to the modulation signal generating device 107.

The modulation signal generator 107 is a signal source to appropriately drive and modulate each of the surface conduction electron emission device in accordance with each of the image data I'd1 through I'dn, and its output signals are applied to the surface conduction electron emission device in the display panel 101 through the terminals Doy1 through Doyn.

Here, the aforesaid surface conduction electron emission device has the following basic features toward the emission current Ie. That is, there is a clear threshold voltage Vth for electron emission, and only when a voltage not less than the threshold voltage, electron emission takes place. For a voltage not less than the threshold voltage, emission current changes in accordance with changes of voltage applied to the elements. Based on this, when pulse-shaped voltage is applied to the present elements, for example, a voltage not more than the electron emission threshold value, electron emission does not take place, but when a voltage not less than the electron emission threshold value is applied, an electron beam is outputted. In that case, changes in the wave height value of the pulses Vm enable to control intensity of the output electron beams. In addition, changes in the pulse width Pw enable to control total quantity of electron charges of the outputted electron beams. Accordingly, as the system to modulate the electron emission device in accordance with the input signals, a voltage modulation system, pulse width modulation system, etc. can be adopted. At the time when the voltage modulation system is implemented, as the modulation signal generator 107, such a circuit of voltage modulation system that generates voltage pulses with a constant length and modulates the wave height value of the pulses appropriately in accordance with the inputted data can be used.

At the time when the pulse width modulation system is implemented, as the modulation signal generator 107, such a circuit of pulse width modulation system that generates voltage pulses with a constant wave height value and modulates the voltage pulse width appropriately in accordance with the inputted data can be used.

As for the shift register 104 or the line memory 105, both of digital signal system and analog signal system can be adopted. The reason is that it is enough if the serial/parallel conversion and memorization on image signals is implemented at a predetermined speed.

In the case where the digital signal system is used, it is necessary to code the output signals DATA of the synchronization signal separation circuit 106 into digital signals, and an A/D converter is well equipped in the output portion of the circuit 106 for this purposes. In this relation, the circuit to be used for the modulation signal generator 107 will become slightly different based on whether the output signals of the line memory 105 are digital signals or analog signals. That is, in case of voltage modulation system using digital signals, D/A conversion circuit for example is used as the modulation signal generator 107, and an amplifying circuit, etc. are attached thereto in accordance with necessity. In case of the pulse width modulation system, as the modulation signal generator 107, used is a circuit combining for example a high speed oscillator, a counter to count waves outputted from the oscillator, and a comparator to compare the output value of the counter and the output value of said memory. In accordance with necessity, an amplifier can be added so that the modulation signals, which have undergone pulse width modulation, to be outputted from the comparator are voltage-amplified to reach the driving voltage of the surface conduction electron emission device.

In case of the voltage modulation system using analog signals, as the modulation signal generator 107, for example an amplifying circuit using operational amplifier can be adopted, and in accordance with necessity, a level shift circuit, etc. can be added thereto. In case of pulse width modulation system, for example a voltage control type oscillation circuit (VOC) can be adopted, and in accordance with necessity, an amplifier can be added so that the voltage is amplified to reach the driving voltage of the surface conduction electron emission device.

In an image display device to which the present invention capable of taking such configurations is applicable, electron emission takes place by applying voltage to each electron emission device via the terminals outside the container comprising Dox1 through Doxm and Doy1 through Doym. High voltage is applied to the metal back 85 or transparent electrode (not shown) via the high voltage terminal Hv so as to accelerate the electron beam. The accelerated electrons strike the fluorescent film 84 so as to cause radiation and form images.

Next, as further another embodiment of the electron source which has been formed using the above-described substrate for forming electron source, an electron source in which a plurality of electron emission devices have been disposed in a latter-shaped formation on the substrate for forming electron source shown in FIG. 1 or FIG. 2 as described above and an image forming apparatus using such an electron source will be described, by using FIG. 15 and FIG. 16.

Figure 15:
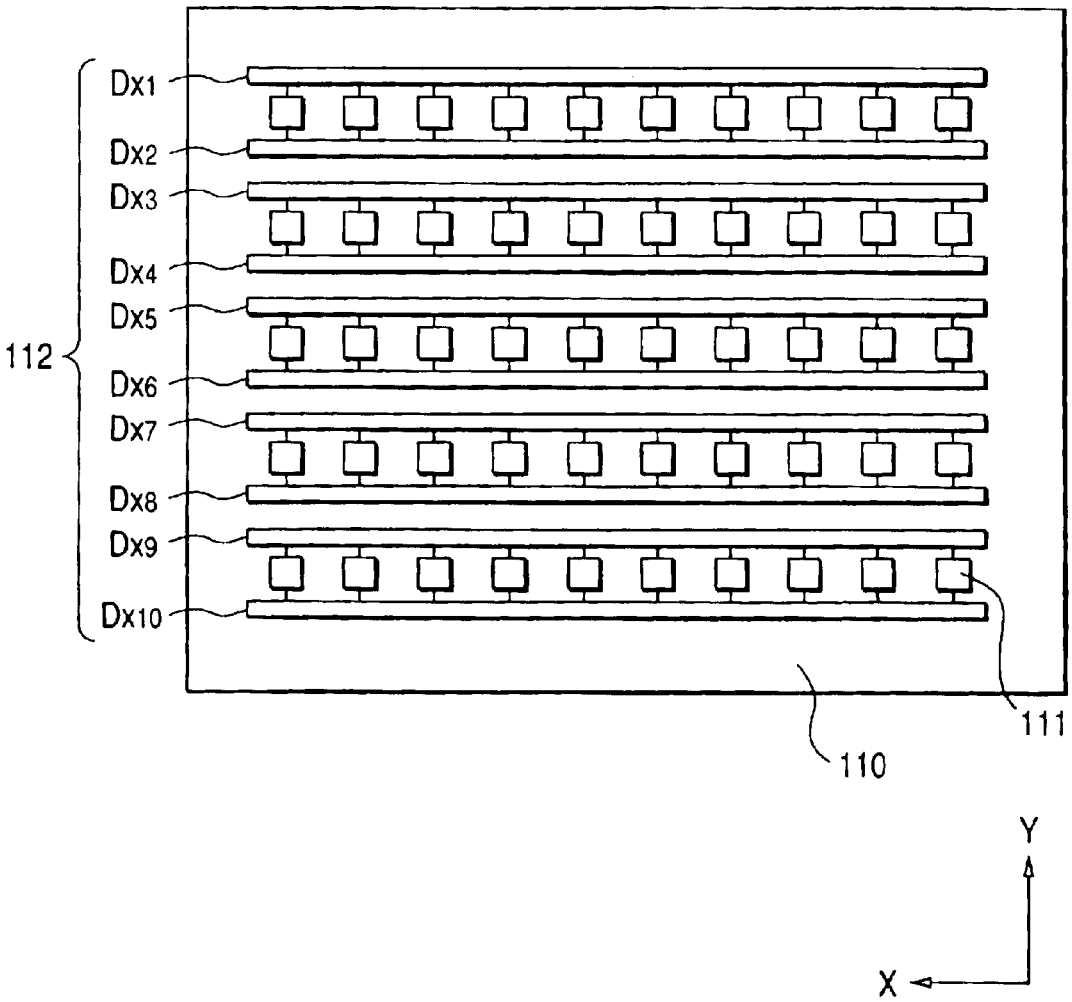
FIG. 15 is a schematic view showing another configuration of the electron source of the present invention.

FIG. 15 is a schematic view showing one example of electron source of ladder-shaped formation. In FIG. 15, the substrate on which said first layer and the second layer have been formed in advance is numbered as 110, and the surface conduction electron emission device is numbered as 111. The common wiring 112 and Dx1 through Dx10 are to connect the surface conduction electron emission devices 111. A plurality of the surface conduction electron emission devices 111 are disposed in parallel in the X direction on the substrate 110 (this is called an element line). A plurality of these element lines are disposed to configure an electron source. Application of driving voltage to between common wiring for each element line can cause each element line to be driven independently. That is, to element lines from which electron beam is desired to be emitted a voltage not less than the electron emission threshold value is applied, and to element lines from which electron beam is not emitted a voltage not more than the electron emission threshold value is applied. For the common wiring Dx2 through Dx9 between each element line the same wiring can be adopted for Dx2 and Dx3 for example.

Figure 16:
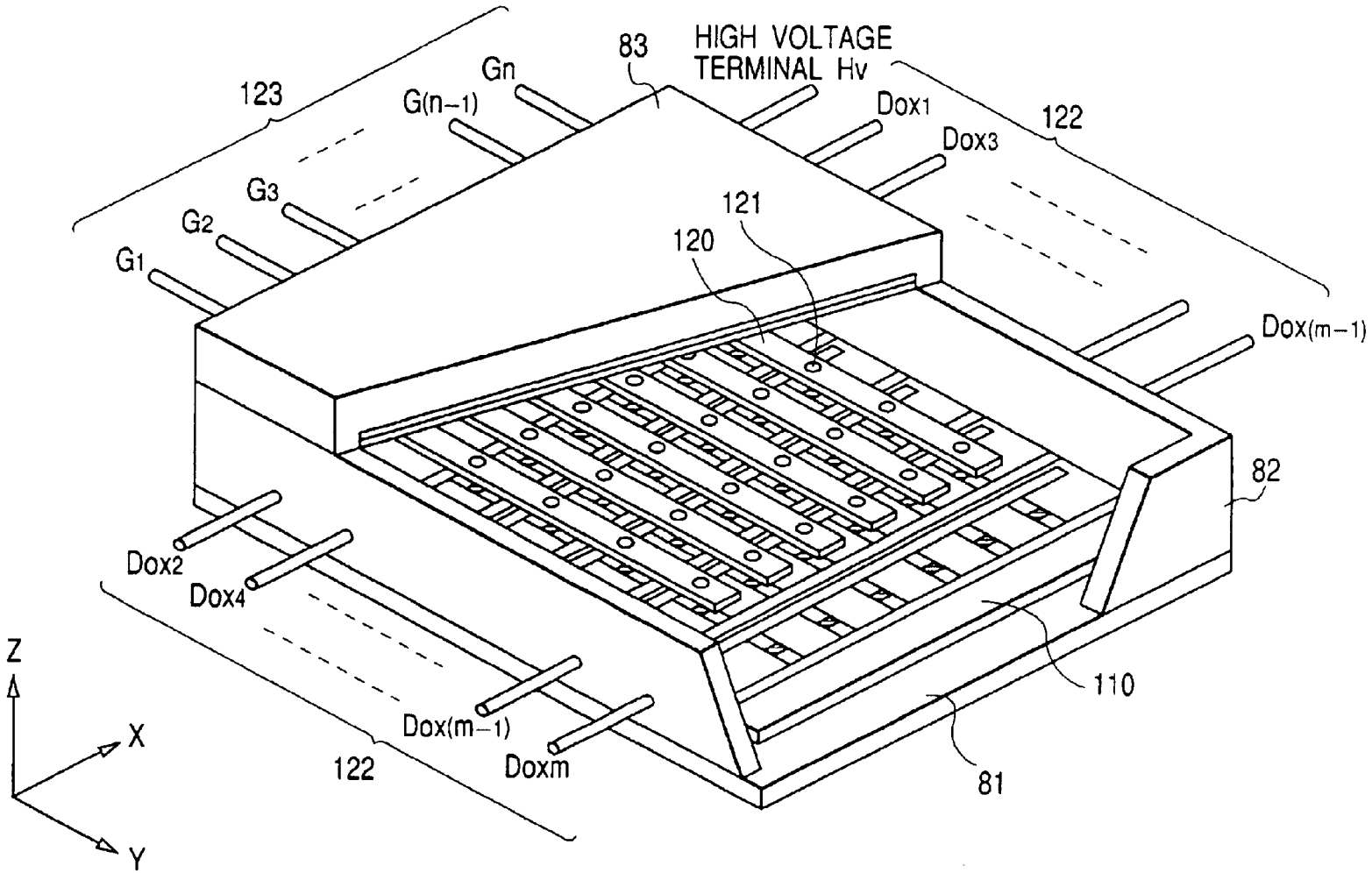
FIG. 16 is a schematic view showing another configuration of the image forming apparatus of the present invention.

FIG. 16 is a schematic view showing one example of a panel configuration in an image forming apparatus comprising an electron source in the ladder-shaped formation. The grid electrode is numbered as 120, the cavity for electron to come through is numbered as 121, and the terminals outside the container comprising Dox1, Dox2, . . . Doxm are numbered as 122. The terminals outside the container comprising G1, G2, . . . Gn which are connected with the grid electrode 120 are numbered as 123, and the electron source substrate in which the common wiring between respective element lines are made one and the same is numbered as 124. In FIG. 16, the same symbols as those shown in FIG. 10 and FIG. 15 are given to the same portion as those shown in these drawings. The big difference between the image forming apparatus shown herein and the image forming apparatus in a simple matrix formation shown in FIG. 10 is whether or not the device comprises the grid electrode 120 between the electron source substrate 110 and the face plate 86.

In FIG. 16, the grid electrode 120 is provided between the substrate 110 and the face plate 86. The grid electrode 120 is the one to modulate the electron beam emitted from the electron emission device, and for the purpose of causing the electron beam to pass through the stripe-shaped electrodes disposed in perpendicular with the element lines in a ladder-shaped formation, one circular opening 121 each corresponding with each element is provided. The shape and the disposing position of the grid will not be limited to the one shown in FIG. 16. For example, as an opening, a number of passing-through openings can be provided in a meshed formation, and the grid can be provided surrounding or in the vicinity of the electron emission device.

The terminals outside the container 122 and the terminals outside the grid container 123 are electrically connected with the not-shown controlling circuit.

The two kinds of configuration of the image forming apparatus having been described herein are one example of image forming apparatus to which the present invention is applicable, and based on the technological philosophy of the present invention, various variants are possible. With respect to the input signals, the NTSC system has been nominated, but the input signals are not limited hereto, and in addition to PAL, ad SECAM system, etc., TV signal systems (for example, high definition TV) comprising more numerous scanning lines can be adopted.

In the image forming apparatus of the present invention, the modulation signals for one line of image are simultaneously applied to the column of grid electrodes in a synchronizing manner when the electron lines are driven (scanned) in succession on a line-by-line bases. This serves to control irradiation of each electron beam to the phosphor, and thus to enable image display on a line-by-line basis. The image forming apparatus of the present invention can be used as the display device for television broadcast, and display device for television conference system, and computers, etc. and in addition, as the image forming apparatus as optical printer configured by using light-sensitive drum, etc.

EMBODIMENTS

When describing particular embodiments, the present invention will be described in detail as follows, but the present invention is not to be limited to those embodiments, but inclusive of any substitutions or design changes on respective elements within a scope where the purpose of the present invention can be achieved.

Embodiment 1, Reference Examples 1 and 2

In the present embodiment, the electron source shown in FIGS. 3A and 3B has been produced in accordance with the manufacturing processes shown in FIGS. 7A to 7D. Incidentally, for the present embodiment, and reference example to be described later, six units of elements have been respectively produced on the same substrate and it has been also studied how the electron emission features reappear.

1) At first, the substrate for forming electron source shown in FIG. 1 is produced.

A blue glass $SiO_2$: 74%, $Na_2O$: 12%, CaO: 9%, $K_2O$:3%, MgO: 2%) is well cleaned and the first layer 6 is formed with the CVD method. The material of this first layer 6 is a phosphorus doped silica glass called PSG (Phosphosilicate Glass), which has been formed so as to get the density of P of 7 weight percentage with the atmospheric pressure CVD method. Incidentally, the source used is TEOS (tetra-ethoxy-silane ($Si(OC_2H_5)_4$)) and TMOP (trimethoxy-phosphate ($PO(OCH_3)_3$)). In addition, the thickness of the first layer 6 at this time is approximately 3 $\mu$m.

Subsequently, the second layer 7 containing $SnO_2$ with $SiO_2$ as the main component with the sputtering method (FIG. 7A). The thickness of the second layer at this time is approximately 100 nm.

Incidentally, as the reference example 1, a blue glass substrate in which neither the above-described first layer 6 nor the above-described second layer 7 have been formed and as the reference example 2, a blue glass substrate in which only the above-described first layer 6 has been formed have been respectively prepared.

2) Next, on each substrate for forming electron source described so far, six units of elements of the surface conduction electron emission devices are formed. First, the element electrodes 2 and 3 are formed.

On each of the above-described substrate for forming electron source the photo resist layer has been formed, and with the photolythography technology, an opening corresponding with the shape of the element electrode has been formed in the photo resist layer. Ti 5 nm and Pt 100 nm have been film-formed thereon by vacuum evaporation method, and the above-described photoresist layer has been solved and removed by an organic solvent, and the element electrodes 2 and 3 have been formed by lift-off (FIG. 7B). At this time, as shown in FIG. 3A, the gap L between the element electrodes has been set at 20 $\mu$m and the electrode length W has been set at 600 $\mu$m. The sheet resistance of each substrate surface, which has been measured thereafter, has been approximately $2\times10^9$ Ω/□ in the present embodiment. In addition, in the reference example 2, the figure has exceeded $10^{10}$ Ω/□.

3) Next, the conductive film 4 is formed. First, for the purpose of forming a mask for pattering of conductive film, Cr film with film thickness of 50 nm has been deposited with the vacuum evaporation method, and with the photolythography technology, an opening corresponding with the shape of the conductive film 4 has been formed in the photo resist layer, and the solution of acetate Pd monoethanolamine complex has been spin-coated thereto with spinner, and been dried, and thereafter, heating and burning processing for 10 minutes under 350° C. has been implemented in the atmosphere to form a conductive film comprising fine particles with PdO as the main component, and thereafter, Cr has been removed with wet etching, and the conductive film 4 in the desired shape has been obtained with lift-off (FIG. 7C).

Figure 17:
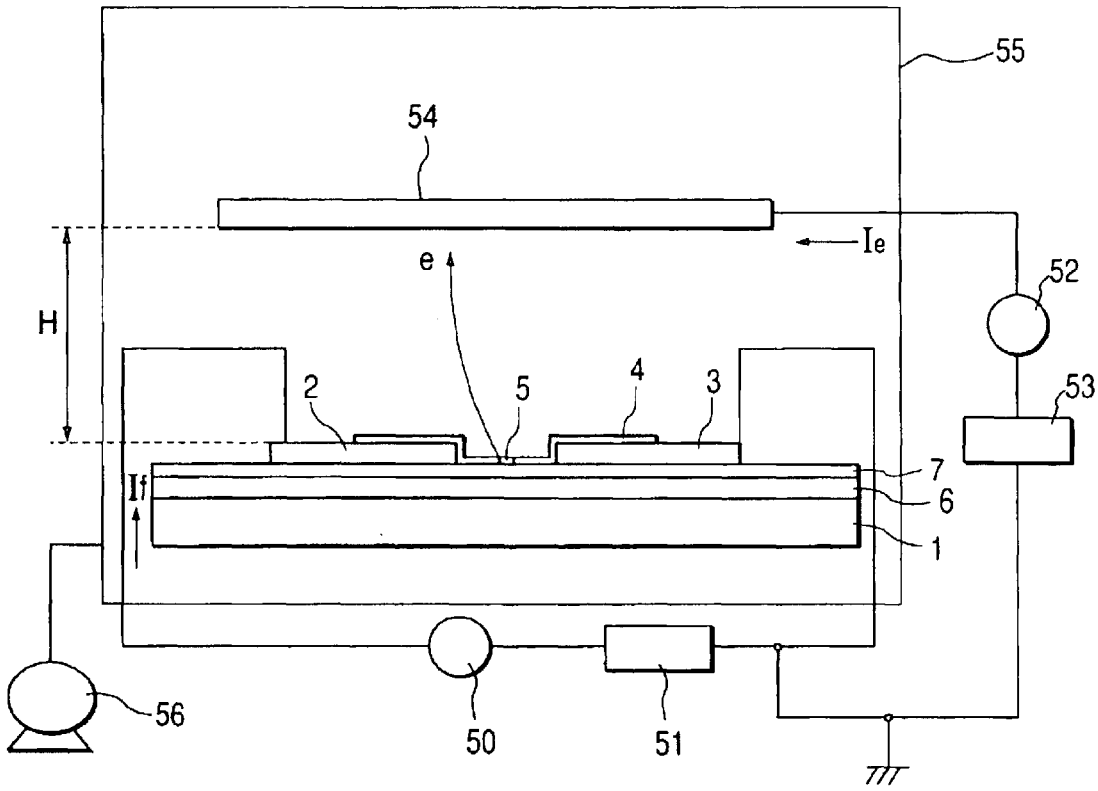
FIG. 17 is a schematic view showing an example of a vacuum processing device comprising measurement assessing function.

Thereafter, the above-described each substrate has been disposed in the vacuum processing device shown as a schematic in FIG. 17.

4) After the pressure inside the vacuum container 55 has been set to approximately $1.3\times10^{-4}$ Pa, the forming processing has been implemented by repeatedly applying pulse voltages between the element electrodes 2 and 3 with the power source 51. Incidentally, for the forming processing, the pulse with wave height value being gradually increased as shown in FIG. 8B has been used and has been set at T1=1 msec, T2=10 msec. Incidentally, the rectangular pulse of pulse width 1 ms and the wave height value 0.1 V has been inserted between the above-described pulses, and thereby the element current If flowing between the element electrodes 2 and 3 has been measured by using the current meter 50, and thus the resistance value between the element electrodes has been detected. At the time point when the detected resistance value has exceeded 1 MΩ, application of the pulse voltage has ended. This processing has served to form the gap 5 in the conductive film 4 (FIG. 7D).

5) Subsequently, activation processing has been implemented. The activation process has been implemented by introducing the evaporated aceton into the vacuum container 55, and keeping the pressure at $2.7\times10^{-1}$ Pa, and applying the rectangular pulses of the wave height value of 18 V between the element electrodes 2 and 3 with the power source 51. With this processing, the changes according to lapse of time on the element current If to be detected by the current meter 50 have been measured to note that the If increases gradually each in the present embodiment, the reference examples 1 and 2, but there are differences in their levels and the element current If has been saturated in the present embodiment in approximately 10 minutes and in the reference example 1 in approximately 30 minutes and in the reference example 2 in approximately 10 minutes. This reveals that, in the present embodiment and in the reference example 2, time period required for the activation process may be short as compared with the reference example 1. This is presumably due to disturbance by Na from the soda-lime glass 1 against activation having been suppressed by the first layer 6 which has been provided in the present embodiment and the reference example 2.

6) Subsequently, the stabilization process has been implemented.

The entire vacuum container 55 has been heated to reach approximately 200° C. with a not-shown heater and ventilated, and ten hours later, at the time point when the pressure inside the vacuum container 55 has reached $8\times10^{-6}$ Pa, the power for the heater heating the vacuum container has been cut off, and the temperature has been made to return to the room temperature, and thereafter, the electron emission features of the produced electron emission device have been measured. The rectangular pulses with the wave height value of 18 V, the pulse width of 1 msec, and the pulse interval of 10 msec have been applied to between the element electrodes 2 and 3, and the potential of the anode electrode 54 has been set to 1 kV, and the distance H between the electron emission device and the anode electrode has been set to 4 mm. With reference to the present embodiment, the reference examples 1 and 2, the six elements for each of them have been driven for ten minutes, and the measured values on the element current If and the emission current Ie in ten minutes have been as follows.

TABLE 1

| | Element current If (mA) | Emission current Ie ($\mu$A) |
|---|---|---|
| Embodiment 1 | 2.7–3.1 | 4.7–5.0 |
| Reference example 1 | 1.2–1.9 | 2.0–3.4 |
| Reference example 2 | 2.6–3.1 | 4.5–4.9 |

Moreover, an endurance assessment over 50 hours has been implemented. The measurement conditions at this time comprise the rectangular pulses with the wave height value of 17 V, the pulse width of 1 msec, and the pulse interval of 10 msec to be applied to between the element electrodes 2 and 3, and the potential of the anode electrode 54 to be set at 2 kV, and the distance H between the electron emission device and the anode electrode to be set at 4 mm. Incidentally, the element current If and the emission current Ie have been measured every 30 seconds. The assessment comprises two items, that is, as concerns the element current If, the element current variation ratio being defined by [(maximum value−minimum value)/(average value)]×100 (%), and as concerns the emission current variation ratio being defined by [(maximum value−minimum value)/(average value)]×100 (%). The outcome is as follows.

TABLE 2

| | Element current variation ratio (%) | Emission current variation ratio (%) |
|---|---|---|
| Embodiment 1 | 1.5–2.0 | 1.6–2.2 |
| Reference example 1 | 25–33 | 28–35 |
| Reference example 2 | 1.6–2.9 | 5.5–8.0 |

Based on Table 1, Table 2 and the above-described features at the time of activation, the present embodiment has shown that it satisfies the following features.

1. As compared with the reference example 1, the time period required for activation can be shortened.

2. As compared with the reference example 1, the element current If and the emission current Ie are large and reappear well.

3. As compared with the reference example 1, the element current variation ratio and the emission current variation ratio are small and are excellent in stability.

4. As compared with the reference example 2, the emission current variation ratio is small and is excellent in stability.

Embodiments 2 to 4

Next, as in embodiment 1, the electron source using the surface conduction electron emission device shown in FIGS. 3A and 3B has been produced in accordance with the manufacturing processes shown in FIGS. 7A to 7D. For each embodiment, six units of elements have been respectively produced on the same substrate and it has been also studied how the electron emission features reappear. Incidentally, although the substrate for forming electron source of the embodiments 2 though 4 is the same as that in embodiment 1 on the point of view that the first layer 6 is formed with the atmospheric pressure CVD method, the material for the first layer 6 is different, and for embodiment 2, the material is the so-called BSG containing B with the $SiO_2$ as a main component, and the density of B is approximately 4 weight percentage. In addition, for embodiment 3, the material is the so-called BPSG containing both of B and P with the $SiO_2$ as a main component, and the density of B and P are approximately 2.5 weight percentage and approximately 7 weight percentage respectively. In addition, for embodiment 4, the material is the so-called GPSG containing both of Ge and P with the $SiO_2$ as a main component, and the density of Ge and P are approximately 4 weight percentage and approximately 7.5 weight percentage respectively. Incidentally, the thickness of the first layer 6 for embodiments 2 to 4 is approximately 3 $\mu$m.

The second layer 7 is configured by comprising the film with thickness of approximately 100 nm containing $SnO_2$ with $SiO_2$ as a main component with spattering method as in embodiment 1.

As in embodiment 1, after the element electrode has been formed, the sheet resistance of each substrate surface, which has been measured thereafter, has been approximately $1\times10^9$ to $3\times10^9$ $\Omega/\square$ all in embodiments 2 to 4.

At first, as concerns the time required for activation, the element current If has been saturated in ten minutes all for embodiments 2 to 4, which has resembled embodiment 1.

Next, the electron emission features of the electron emission device have been measured. The rectangular pulses with the wave height value of 18 V, the pulse width of 1 msec, and the pulse interval of 10 msec have been applied to between the element electrodes 2 and 3, and the potential of the anode electrode 54 has been set at 1 kV, and the distance H between the electron emission device and the anode electrode has been set at 4 mm. With reference to embodiments 2 to 4, the six elements for each of them have been driven for ten minutes, and the measured values on the element current If and the emission current Ie in ten minutes have been as follows.

TABLE 3

| | Element current If (mA) | Emission current Ie ($\mu$A) |
|---|---|---|
| Embodiment 2 | 2.6–3.2 | 4.5–5.0 |
| Embodiment 3 | 2.7–3.2 | 4.4–4.8 |
| Embodiment 4 | 2.8–3.4 | 4.6–5.2 |

Moreover, an endurance assessment over 50 hours has been implemented. The measurement conditions at this time comprise the rectangular pulses with the wave height value of 17 V to be applied to between the element electrodes 2 and 3, the pulse width of 1 msec, and the pulse interval of 10 msec, and the potential of the anode electrode 54 to be set at 2 kV, and the distance H between the electron emission device and the anode electrode to be set at 4 mm. Incidentally, the element current If and the emission current Ie have been measured every 30 seconds. The assessment comprises two items, that is, as concerns the element current If, the element current variation ratio being defined by [(maximum value−minimum value)/(average value)]×100 (%), and as concerns the emission current variation ratio being defined by [(maximum value−minimum value)/(average value)]×100 (%). The outcome is as follows.

TABLE 4

| | Element current variation ratio (%) | Emission current variation ratio (%) |
|---|---|---|
| Embodiment 2 | 1.7–2.1 | 1.7–2.3 |
| Embodiment 3 | 1.5–2.1 | 1.5–2.3 |
| Embodiment 4 | 1.6–2.2 | 1.7–2.4 |

As these results reveal, as in embodiment 1, any of the electron sources of present embodiments 2 though 4, requires only short time for activation, and moreover, provides large emission current, and makes the element current variation ratio as well as the emission current variation ratio small, and is excellent in stability.

Embodiments 5 to 8

Next, as in embodiment 1, the electron source using the surface conduction electron emission device shown in FIGS. 3A and 3B has been produced in accordance with the manufacturing processes shown in FIGS. 7A to 7D. For each embodiment, six units of elements have been respectively produced on the same substrate and it has been also studied how the electron emission features reappear. Incidentally, although embodiments 5 to 8 are common on the point of view that the first layer 6 is formed with the atmospheric pressure CVD method, and PSG with density of P being approximately 7 weight percent and with thickness of approximately 3 $\mu$m, the material for the second layer and the forming method are different In embodiment 5, the second layer, the materials for which include In with $SiO_2$ as the main component, has been formed with CVD method to have thickness of approximately 50 nm. Incidentally, as the In source, In $(C_2H_5)_3$ has been used.

In embodiment 6, the second layer, the materials for which include Sn with $SiO_2$ as the main component, has been formed with CVD method to have thickness of approximately 50 nm. Incidentally, as the Sn source, $(CH_3)_4Sn$ has been used.

In embodiment 7, the second layer, the materials for which include Sb with $SiO_2$ as the main component, has been formed with spattering method to have thickness of approximately 100 nm.

In embodiment 8, the second layer, the materials for which include Re with $SiO_2$ as the main component, has been formed with spattering method to have thickness of approximately 100 nm.

First, in the stage where the electron electrodes have been formed in the above-described substrate for forming electron source of each embodiment, the sheet resistance value of the substrate surface has been measured. The result thereof if shown as follows.

TABLE 5

| | Sheet resistance value (Ω/□) |
|---|---|
| Embodiment 5 | $3 \times 10^{31\ 9}$ |
| Embodiment 6 | $8 \times 10^{31\ 8}$ |
| Embodiment 7 | $2 \times 10^{31\ 9}$ |
| Embodiment 8 | $6 \times 10^{31\ 8}$ |

Table 5 reveals that the sheet resistance value each of embodiments 5 to 8 is $10^8$ to $10^{10}$ Ω/□.

Next, as concerns the time required for activation, the element current If has been saturated in ten minutes all for embodiments 5 to 8, and the required time has been shorter compared with said reference embodiment 1. In addition, the element current If has generally shown changes according to lapse of time as in embodiment 1.

Next, the electron emission features of the electron emission device have been measured. The rectangular pulses with the wave height value of 18 V, the pulse width of 1 msec, and the pulse interval of 10 msec have been applied to between the element electrodes 2 and 3, and the potential of the anode electrode 54 has been set at 1 kV, and the distance H between the electron emission device and the anode electrode has been set at 4 mm. With reference to embodiments 5 to 8, the six elements for each of them have been driven for ten minutes, and the measured values on the element current If and the emission current Ie in ten minutes have been as follows.

TABLE 6

| | Element current If (mA) | Emission current Ie (μA) |
|---|---|---|
| Embodiment 5 | 2.5–3.3 | 4.4–5.0 |
| Embodiment 6 | 2.6–3.4 | 4.7–5.2 |
| Embodiment 7 | 2.7–3.3 | 4.5–5.1 |
| Embodiment 8 | 2.6–3.1 | 4.3–4.9 |

Moreover, an endurance assessment over 50 hours has been implemented. The measurement conditions at this time comprise the rectangular pulses with the wave height value of 17 V to be applied to between the element electrodes 2 and 3, the pulse width of 1 msec, and the pulse interval of 10 msec, and the potential of the anode electrode 54 to be set at 1 kV, and the distance H between the electron emission device and the anode electrode to be set at 4 mm. Incidentally, the element current If and the emission current Ie have been measured every 30 seconds. The assessment comprises two items, that is, as concerns the element current If, the element current variation ratio being defined by [(maximum value−minimum value)/(average value)]×100 (%), and as concerns the emission current variation ratio being defined by [(maximum value−minimum value)/(average value)]×100 (%). The outcome is as follows.

TABLE 7

| | Element current variation ratio (%) | Emission current variation ratio (%) |
|---|---|---|
| Embodiment 5 | 1.9–2.2 | 2.0–2.5 |
| Embodiment 6 | 1.5–2.0 | 1.7–2.4 |
| Embodiment 7 | 1.7–2.1 | 2.3–2.8 |
| Embodiment 8 | 1.7–2.2 | 2.1–2.6 |

As these results reveal, as in embodiment 1, any of the electron sources of the present embodiments 5 to 8, requires only short time for activation, and moreover, provides large emission current, and makes the element current variation ratio as well as the emission current variation ratio small, and is excellent in stability.

Embodiment 9

As the present embodiment, the electron source using the surface conduction electron emission device shown in FIGS. 4A and 4B has been produced. Incidentally, six units of the surface conduction electron emission devices have been produced on the following substrate and it has been also studied how the electron emission features reappear.

1) At first, the substrate for forming electron source shown in FIG. 2 is produced.

A high strain point glass ($SiO_2$: 58%, $Na_2O$: 4%, $K_2O$: 7%, MgO: 2% are included) is well cleaned and mixture solution of $SnO_2$ fine particles and organic silicon compound which has been resistance-adjusted by doping phosphorus has been spin-coated and has undergone drying. Moreover, solution of organic silicon compound only has been spin-coated, and thereafter burning under 500° C. has been implemented for 30 minutes with an oven. As a result, on the high strain point glass substrate, the second layer of thickness 300 nm, which comprises $SnO_2$ fine particles and organic silicon compound which has been resistance-adjusted by doping phosphorus by a weight ratio of 80:20, has been formed, and moreover, as the layer thereabove, the first layer made of $SiO_2$ with thickness of 60 nm has been formed.

2) Next, on the above-described substrate for forming electron source, six units of elements of the surface conduction electron emission devices are formed as shown in FIGS. 7B to 7D. First, the element electrodes 2 and 3 are formed.

On the above-described substrate the photo resist layer has been formed, and with the photolythography technology, an opening corresponding with the shape of the element electrode has been formed in the photo resist layer. Ti 5 nm and Pt 100 nm have been film-formed thereon by vacuum evaporation method, and the above-described photoresist layer has been solved and removed by an organic solvent, and the element electrodes 2 and 3 have been formed by lift-off (FIG. 7B). At this time, as shown in FIG. 4A, the gap L between the element electrodes has been set at 20 μm and the electrode length W has been set at 600 μm. The sheet resistance of substrate surface, which has been measured thereafter, has been approximately $2\times10^{12}$ Ω/□.

3) Next, the conductive film 4 is formed. First, for the purpose of forming a mask for pattering of conductive film, Cr film with film thickness of 50 nm has been deposited with the vacuum evaporation method, and with the photolythography technology, an opening corresponding with the shape of the conductive film 4 has been formed in the photo resist layer, and the solution of acetate Pd monoethanolamine complex has been spin-coated thereto with spinner, and been dried, and thereafter, heating and burning processing for 10 minutes under 350° C. has been implemented in the atmosphere to form a conductive film comprising fine particles with PdO as the main component, and thereafter, Cr has been removed with wet etching, and the conductive film 4 in the desired shape has been obtained with lift-off (FIG. 7C).

Thereafter, the above-described each substrate has been disposed in the vacuum processing device shown as a schematic in FIGS. 4A and 4B.

4) After the pressure inside the vacuum container 55 has been set around $1.3\times10^{-4}$ Pa, the forming processing has been implemented by repeatedly applying pulse voltages between the element electrodes 2 and 3 with the power source 51. Incidentally, for the forming processing, the pulse with wave height value being gradually increased as shown in FIG. 8B has been used and has been set at T1=1 msec, T2=10 msec. Incidentally, the rectangular pulse of pulse width 1 ms and the wave height value 0.1 V has been inserted between the above-described pulses, and thereby the element current If flowing between the element electrodes 2 and 3 has been measured using the current meter 50, and thus the resistance value between the element electrodes has been detected. At the time point when the detected resistance value has exceeded 1 MΩ, application of the pulse voltage has ended. This processing has served to form the gap 5 in the conductive film 4 (FIG. 7D).

5) Subsequently, activation processing has been implemented. The activation process has been implemented by introducing the evaporated aceton into the vacuum container 55, and keeping the pressure at $2.7\times10^{-1}$ Pa, and applying the rectangular pulses of the wave height value of 18 V between the element electrodes 2 and 3 with the power source 51. With this processing, the changes according to lapse of time on the element current If to be detected by the current meter 50 have been measured to note that the element current If has been saturated in approximately 10 minutes.

6) Subsequently, the stabilization process has been implemented. The entire vacuum container 55 has been heated to reach approximately 200° C. with a not-shown heater and ventilated, and ten hours later, at the time point when the pressure inside the vacuum container 55 has reached $8\times10^{-6}$ Pa, the power for the heater heating the vacuum container has been cut off, and the temperature has been made to return to the room temperature, and thereafter, the electron emission features of the produced electron emission device have been measured. The rectangular pulses with the wave height value of 18 V, the pulse width of 1 msec, and the pulse interval of 10 msec have been applied to between the element electrodes 2 and 3, and the potential of the anode electrode 54 has been set at 1 kV, and the distance H between the electron emission device and the anode electrode has been set at 4 mm. The six elements of the present embodiment have been driven for ten minutes, and the element current If has been 2.5 to 3.1 mA and the measured values on the emission current Ie have been 4.5 to 5.1 μA in ten minutes.

Moreover, an endurance assessment over 50 hours has been implemented. The measurement conditions at this time comprise the rectangular pulses with the wave height value of 17 V, the pulse width of 1 msec, and the pulse interval of 10 msec to be applied to between the element electrodes 2 and 3, and the potential of the anode electrode 54 to be set at 2 kV, and the distance H between the electron emission device and the anode electrode to be set at 4 mm. Incidentally, the element current If and the emission current Ie have been measured every 30 seconds. The assessment comprises two items, that is, as concerns the element current If, the element current variation ratio being defined by [(maximum value−minimum value)/(average value)]×100 (%), and as concerns the emission current variation ratio being defined by [(maximum value−minimum value)/(average value)]×100 (%), and they have fallen within the range of 1.3 to 1.8% and 1.4 to 1.9% respectively.

Considering features described so far, the present embodiment requires only short time for activation, and moreover, provides large element current If and emission current Ie, and is excellent in recurrence and stability.

Embodiment 10

Figure 18:
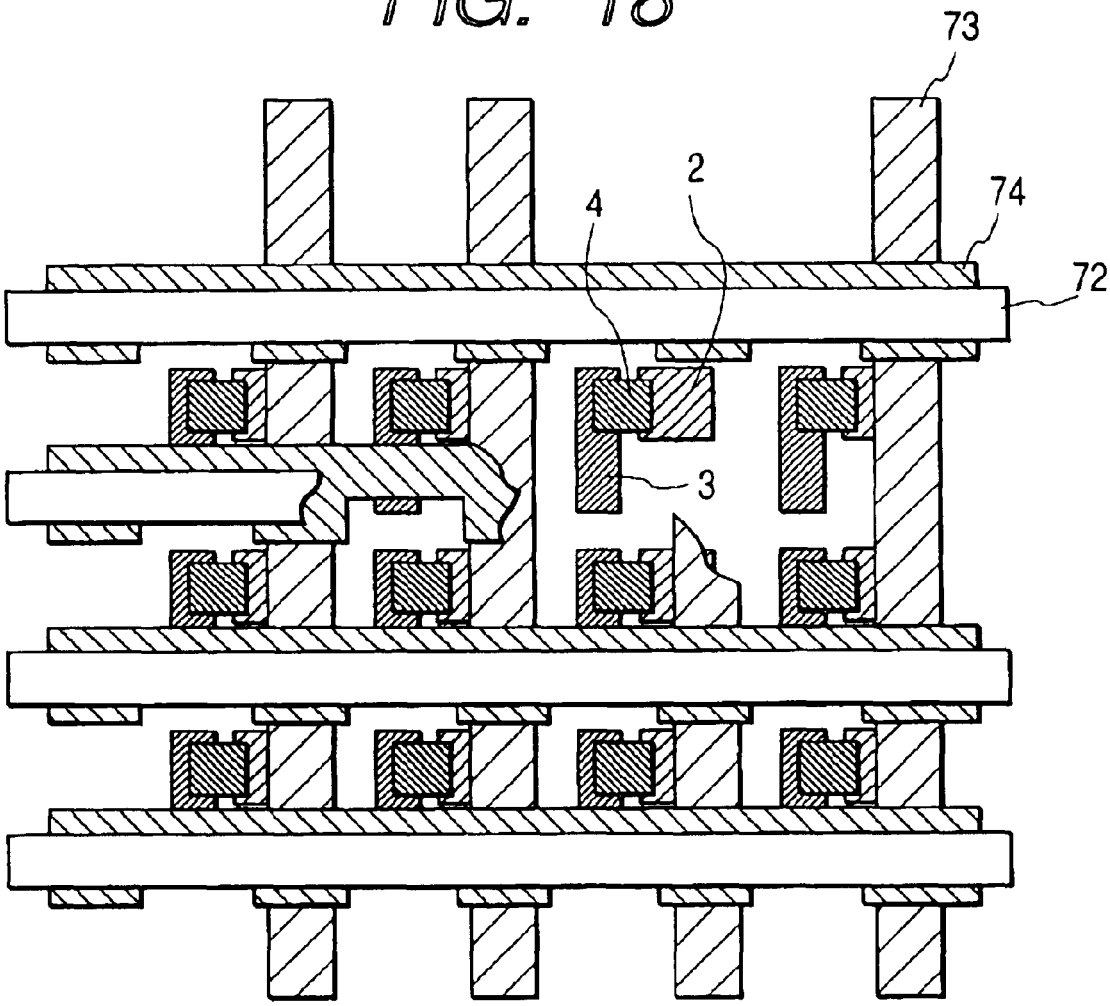
FIG. 18 is a schematic view showing still another configuration of an electron source of the present invention.

In the present embodiment, on the substrate for forming electron source shown in FIG. 1, a plurality of surface conduction electron emission devices as shown in FIGS. 3A and 3B has been disposed as shown schematically in FIG. 18 a schematic, and the electron source in which matrix-shaped wiring has been disposed has been produced. Incidentally, in the drawing, a part of members has been eliminated for the purpose of making the configuration easier to understand. With reference to FIGS. 19A to 19E, the producing method will be described.

[Process 1]

The soda-lime glass having composition as in embodiment 1 is sufficiently cleaned with detergent, pure water, and thereafter the first layer 1 is formed with CVD method. The material for this first layer is PSG, and has been formed with CVD method so that density of P is 7 weight percent. Incidentally, the source gases having been used in this occasion are TEOS and TMOP. In addition, the first layer has been formed to have thickness of approximately 3 μm.

[Process 2]

In immediate succession to process 1, supply of TMOP being the source of P has been stopped, and $(CH_3)_4Sn$ being the source of Sn has been introduced in addition, thus the second layer has been formed. At this time, thickness of the second layer is approximately 50 nm. In this process, a mixed layer of $SiO_2$, and $SnO_2$ is formed.

[Process 3]

On the substrate for forming electron source 71 having been produced in the processes 1 and 2 described so far as shown in FIG. 1, a pair of element electrodes 2 and of the surface conduction electron emission device shown in FIGS. 8A and 8B are formed.

First, on the above-described substrate 71, a pattern of MOD paste (DU-2110: produced by Noritake Co., Ltd.) in the shape of the element electrodes 2 and 3 has been formed with screen printing method. The MOD paste includes gold as metal component.

Figure 19A:
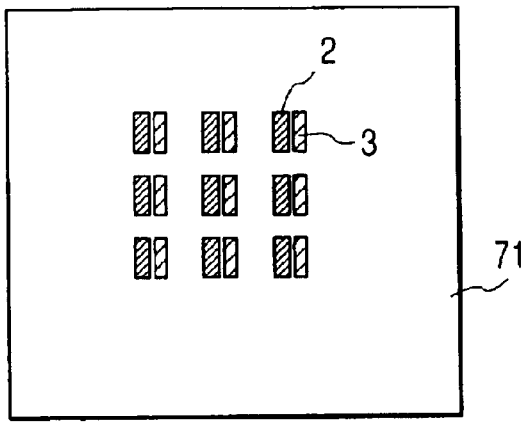
FIGS. 19A, 19B, 19C, 19D and 19E are schematic views describing the manufacturing means of the electron source with configuration shown in FIG. 14.

After printing, undergoing drying at 110° C. for 20 minutes, and subsequently the above-described MOD paste has been burnt by thermal processing device under conditions of the peak temperature of 580° C. and the peak holding time of 8 minutes, and element electrodes 2 and 3 with thickness of 0.3 μm have been formed. The interval between element electrodes has been set at 70 μm (FIG. 19A).

[Process 4]

Figure 19B:
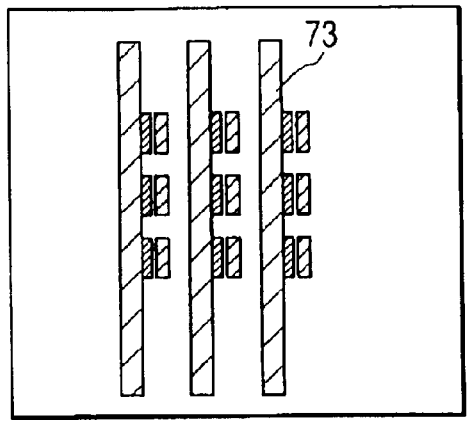

Subsequently, using a paste material containing silver as metal component (NP-4028A: produced by Noritake Co., Ltd.), a pattern of underlining wiring 73 has been formed with screen printing method, and undergoing burning under conditions as in process 3, the underlining wiring (the column direction wiring) 73 has been formed (FIG. 19B).

[Process 5]

Figure 19C:
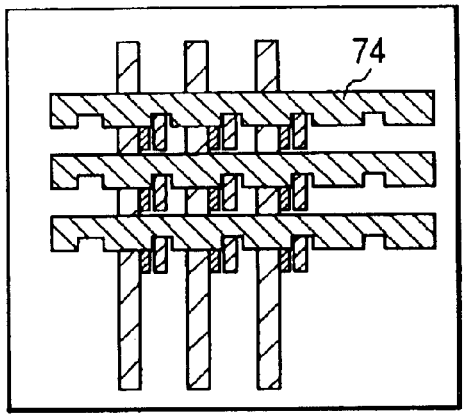
Figure 19D:
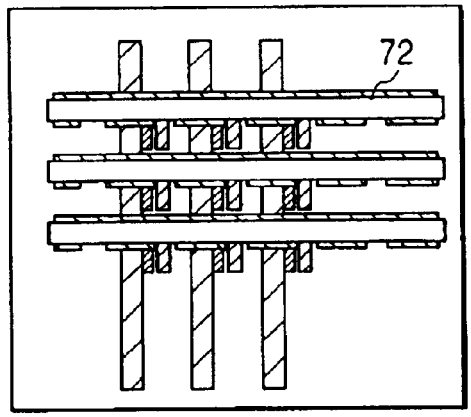

Next, using a paste with PbO as a main component, the pattern of inter-layer insulation layer 74 has been printed and burnt under conditions as in process 3, the inter-layer insulation layer 74 has been formed (FIG. 19C). The inter-layer insulation layer comprises cutoff portions so that one of the element electrodes 2 and 3 is connected with the upper wiring (row direction wiring) to be formed in the later process.

[Process 6]

With a method as in process 4, the upper wiring (row direction wiring) 72 has been formed (FIG. 19D), and a matrix wiring comprising a plurality of underlining wiring (column direction wiring) 73 and a plurality of upper wiring (row direction wiring) 72. After the present process has ended, the sheet resistance value of the surface of the substrate 71 has been measured, and been around $2\times10^9$ to $5\times10^9$ Ω/□ with slight difference depending on the measured spots.

[Process 7]

Figure 19E:
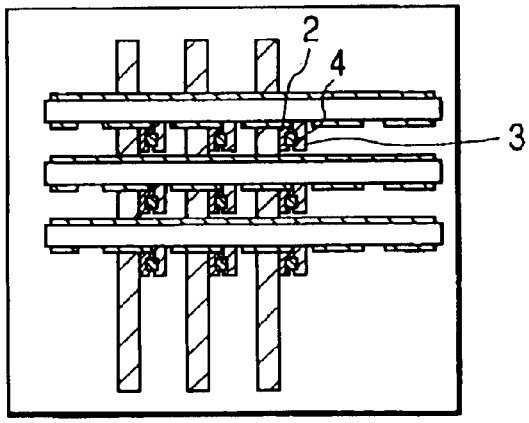

Subsequently, the conductive film 4 has been formed between the above-described each pair of element electrodes 2 and 3. A solution containing organic paradium has been applied with an ink jet injection device of bubble jet system so as to give width of 200 μm. Thereafter, heating processing has been implemented under the temperature of 350° C. for ten minutes, and the conductive film 4 comprising paradium oxide fine particles has been obtained (FIG. 19E).

[Process 8]

As in process 10, the substrate 71 having been manufactured in the above-described processes 1 to 7 has been combined with a rear plate 81, face plate 86 (the fluorescent film 84 and the metal back 85 have been formed on the interior wall surface of the glass substrate 83.), and a supporting frame 82 to undergo junction. Incidentally, a getter for high frequency heating, though not shown, is disposed inside the enclosure, and, though likewise not shown, a ventilation tube to control the atmosphere inside the enclosure is attached to inside the enclosure. Junction has been implemented with flit glass having been applied on the junction portions, and undergone heating processing under the temperature of 450° C. for 10 minutes in the atmosphere.

For the fluorescent film 84 having been used in the present embodiment, the phosphor 92 as shown as a schematic in FIG. 11A has been disposed in a stripe shape, and the phosphor 92 has been formed by first forming black stripe comprising black member 91 and then between them the phosphor 92 corresponding with the basic three colors has been formed. The quality of the black member comprises normally commonly used graphite as a main component, and slurry method has been used for application of the phosphor.

On the fluorescent film, the metal back 85 is provided. In the present embodiment, the metal back has been formed by implementing smoothing processing on the surface of the fluorescent film (normally called "filming"), and thereafter depositing Al using vacuum evaporation method. Incidentally, for the purpose of improving conductivity, a transparent electrode may be provided between the fluorescent film 84 and the glass substrate 83, but in the present embodiment, the above-described configuration has given sufficient conductivity, the transparent electrode has not been provided.

At the time when the above-described junction is implemented, it is necessary to proceed with corresponding the position of the phosphor with the electron emission device strictly, and the positioning has been conducted carefully.

[Process 9]

In the above-described process, the interior of the enclosure 88, which has been configured by comprising a face plate 86, a rear plate 81, and a supporting frame 82, has been ventilated with a ventilation device (using an oil diffusion pump as the main pump) via exhaust tube (not shown) so that the pressure lowers to reach not more than $1.3\times10^{-3}$ Pa, and thereafter, the pulse voltages have been applied as in embodiments 1 to 9 to between a plurality of pairs of element electrodes 2 and 3 through the row direction wiring 72 and the column direction wiring 73, and thus, for each of a plurality of conductive films 4, the gaps 5 shown in FIGS. 3A and 3B have been formed. This processing is implemented on a line-by-line basis for the elements connected with one of row direction wirings, and the processing for that line is over when the resistance per element has exceeded 1 MΩ, and then the stage goes forward to next line. This has been repeated until all the elements have been processed.

[Process 10]

Subsequently, the activation processing has been implemented by repeatedly applying to each element line the rectangular pulse voltages with the wave height value of 20 V. Due to the oil diffusion pump, which is used as the ventilation device, organic substances exist inside the enclosure, and the activation processing is implemented. Subsequently, the ventilation device is switched by the one using a magneto-floating type turbo pump, and ventilation is implemented while heating the entire outer container, thereby the stabilization processing is implemented, and after the getter processing with high frequency heating method has been implemented, the exhaust tube has been heated, melted, and sealed out.

After completion of the above-described process, the pulse voltage with wave height value of 20 V has been applied to each element line respectively for one minute, the electron emission features of each element line have been measured. Incidentally, the height of the supporting frame is 3 mm, and the anode voltage is 1 kV. As a result, the electron emission quantity of each element line has shown deviation of around 4 percent and have been extremely uniform.

Subsequently, white color has been displayed in the entire screen, and the brightness distribution has been observed to confirm that the embodiment is excellent in uniform brightness. In addition, changes in brightness distribution according to lapse of time has been observed to reveal that the range of brightness distribution falls within around 6 percent, and an extremely good result has been obtained. This deems to occur since the sheet resistance value of the substrate surface where the electron emission device is formed is controlled, and thus changes in electron beams are effectively regulated.

Under this state, light has been displayed for 10 hours, and brightness has been measured regularly at a certain spot, generally changes around five percent has only taken place, and extremely stable features have been able to be maintained.

Embodiment 11

The present embodiment has been manufactured with procedures as in embodiment 10 in terms of configuration and production method except process 2 in embodiment 10 having been changed to the below-mentioned process 2'.

[Process 2']

In immediate succession to process 1, $In(C_2H_5)_3$ being the source of In has been introduced in addition, thus the second layer has been formed. At this time, thickness of the second layer is approximately 50 nm. In this process, a mixed layer of PSG and $In_2O_3$ is formed.

As in embodiment 10, the sheet resistance value of the surface of the substrate has been measured, and been around $8\times10^8$ to $2\times10^9$ Ω/□. Next, assessment as in embodiment 10 has been implemented, and features generally as in embodiment 10 have been shown and very preferable results have been obtained.

Embodiment 12

The present embodiment has been manufactured with procedures as in embodiment 10 except the processes 1 and 2 in embodiment 10 having been changed to the below-mentioned process 1' and an electron source, in which as shown in FIG. 18 a plurality of surface conduction electron emission devices have been matrix-wired, has been manufactured on the substrate for forming electron source shown in FIG. 2.

[Process 1']

First, the substrate for forming electron source shown in FIG. 2 is produced.

A high strain point glass ($SiO_2$: 58%, $Na_2O$: 4%, $K_2O$: 7%, MgO: 2% are included) is well cleaned and mixture solution of $SnO_2$ fine particles and organic silicon compound which has been resistance-adjusted by doping phosphorus has been spin-coated and has undergone drying. Moreover, solution of organic silicon compound only has been spin-coated, and thereafter burning under 500° C. has been implemented for 30 minutes with an oven. As a result, on the high strain point glass substrate, the second layer of thickness 300 nm, which comprises $SnO_2$ fine particles and organic silicon compound which has been resistance-adjusted by doping phosphorus by a weight ratio of 80:20, has been formed, and moreover, as the layer thereabove, the first layer made of $SiO_2$ with thickness of 60 nm has been formed.

On the above-described substrate for forming electron source, process 3 and the processes thereafter in embodiment 10 have been implemented likewise, and the electron source as shown in FIG. 18, and the image forming apparatus as shown in FIG. 10 using the electron source have been produced.

The electron source and the image forming apparatus of the present embodiment also have been able to obtain effects as in the above-described embodiments 10 and 11.

As described so far, the present invention gives rise to the effects as follows.

The present invention can provide a substrate for forming an electron source in which changes according to the lapse of time in the electron emission features of the electron emission device are reduced, and the manufacturing method thereof.

In addition, the present invention can provide an electron source in which changes according to the lapse of time in the electron emission features of the electron emission device are reduced, and an image forming apparatus having used the electron source, and moreover the manufacturing method thereof.

In addition, the present invention can provide a substrate for forming an electron source in which dispersion of electron emission features between a plurality of electron emission devices is reduced, and the manufacturing method thereof.

In addition, the present invention can provide an electron source and an image forming apparatus having used the electron source, and moreover the manufacturing method thereof.

In addition, the present invention can provide an image forming apparatus in which dispersion of brightness has been reduced.

In addition, the present invention can provide an image forming apparatus in which brightness changes according to the lapse of time have been reduced.

What is claimed is:

1. An electron source comprising:

a substrate containing Na;

a first layer containing $SiO_2$ as a main component formed directly or indirectly on said substrate;

a second layer containing an electron conductive oxide formed directly or indirectly on said substrate; and an electron-emitting material and an electrode connected with said electron-emitting material;

wherein said electron-emitting material and said electrode are disposed on said first layer or said second layer.

2. An image forming apparatus comprising:

an electron source according to claim 1; and an image forming member to form an image with irradiation of electrons emitted from the electron source.

3. The electron source according to claim 1, wherein said first layer is formed on said substrate containing Na, and said second layer is formed on the first layer.

4. The electron source according to claim 3, wherein said second layer contains $SiO_2$ as its ingredient.

5. The electron source according to claim 4, wherein said first layer contains at least one kind of element to be selected from an element group comprising P, B, and Ge.

6. The electron source according to claim 3, wherein said first layer contains at least one kind of element to be selected from an element group comprising P, B, and Ge.

7. An electron source comprising:

a substrate;

a first layer containing $SiO_2$ as a main component formed directly or indirectly on said substrate;

a second layer containing an electron conductive oxide formed directly or indirectly on said substrate; and an electron-emitting material and an electrode connected with said electron-emitting material;

wherein said electron-emitting material and said electrode are disposed on said first layer or said second layer.

8. The electron source according to claim 7, wherein said first layer is formed on said substrate, and said second layer is formed on the first layer.

9. The electron source according to claim 8, wherein said second layer contains $SiO_2$ as its ingredient.

10. The electron source according to claim 9, wherein said first layer contains at least one kind of element to be selected from an element group comprising P, B and Ge.

11. The electron source according to claim 8, wherein said first layer contains at least one kind of element to be selected from an element group comprising P, B and Ge.

* * * * *

UNITED STATES PATENT AND TRADEMARK OFFICE

CERTIFICATE OF CORRECTION

PATENT NO. : 6,849,999 B1
APPLICATION NO. : 09/440535
DATED : February 1, 2005
INVENTOR(S) : Tamaki Kobayashi et al.

It is certified that error appears in the above-identified patent and that said Letters Patent is hereby corrected as shown below:

ON TITLE PAGE ITEM [56] REFERENCES CITED line 3, Foreign Patent Documents, "60015644" should read --60-015644--;
line 4, Foreign Patent Documents, "07331450" should read --07-331450--;
line 6, Foreign Patent Documents, "09293448" should read --09-293448--;
line 7, Foreign Patent Documents, "10188854" should read --10-188854--; after 10-241550 insert the Following:
Foreign Patent Documents, insert: --JP 2-630988 4/1997--;
Foreign Patent Documents, insert: --JP 2-630983 4/1997--;
Foreign Patent Documents, insert: --JP 1-298624 12/1989--;
Foreign Patent Documents, insert: --JP 8-329828 12/1996--;
Foreign Patent Documents, insert: --JP 9-27285 1/1997--;
Foreign Patent Documents, insert: --JP 9-22668 1/1997--;
Foreign Patent Documents, insert: --JP 6-267461 9/1994--; and
Foreign Patent Documents, insert: --JP 1-279538 11/1989--.

ON TITLE PAGE ITEM [56] REFERENCES CITED

Other Publications, line 1, "Opeeration" should read --Operation--; and "In" should read --in--.

ON TITLE PAGE ITEM [57] ABSTRACT

Line 6, "wish" should read --with--.

COLUMN 1

Line 26, "Molybdenium" should read --Molybdenum--;
Line 29, "J Apply." should read --J. Appl.--;
Line 38, "et al," should read --et al.,--;
Line 42, "et al," should read --et al.,--;
Line 51, "flit" should read --frit--;
Line 60, "flit" should read --frit--; and
Line 63, "flit" should read --frit--.

COLUMN 2

Line 9, "aforementioend" should read --aforementioned--; and
Line 14, "takes" should read --take--.

UNITED STATES PATENT AND TRADEMARK OFFICE

CERTIFICATE OF CORRECTION

PATENT NO. : 6,849,999 B1
APPLICATION NO. : 09/440535
DATED : February 1, 2005
INVENTOR(S) : Tamaki Kobayashi et al.

It is certified that error appears in the above-identified patent and that said Letters Patent is hereby corrected as shown below:

COLUMN 4

Line 7, “details” should read --detail--; and
Line 54, “have” should read --has--.

COLUMN 7

Line 21, “oxice” should read --oxides--; and
Line 52, “the above” should read --the above,--.

COLUMN 10

Line 42, “germaium” should read --germanium--; and
Line 60, “fist” should read --first--.

COLUMN 11

Line 64, “be” should read --been--.

COLUMN 12

Line 17, “flit” should read --frit--; and
Line 50, “has” should read --have--.

COLUMN 13

Line 26, “ample” should read --ampule--.

COLUMN 14

Line 67, “thorough” should read --through--.

COLUMN 15

Line 12, “portions” should read --portion--.

COLUMN 16

Line 30, “purposes.” should read --purpose.--.

UNITED STATES PATENT AND TRADEMARK OFFICE

CERTIFICATE OF CORRECTION

PATENT NO. : 6,849,999 B1
APPLICATION NO. : 09/440535
DATED : February 1, 2005
INVENTOR(S) : Tamaki Kobayashi et al.

It is certified that error appears in the above-identified patent and that said Letters Patent is hereby corrected as shown below:

COLUMN 18

Line 13, "bases." should read --basis.--; and
Line 44, "MgO:2%)" should read --MgO:2%--.

COLUMN 19

Line 1, "substrate" should read --substrates--;
Line 3, "photolythography" should read --photolithography--;
Line 17, "pattering" should read --patterning--; and
Line 19, "photolythog-" should read --photolithog- --.

COLUMN 21

Line 25, "though" should read --through--.

COLUMN 22

Line 37, "though" should read --through--; and
Line 56, "different" should read --different.--.

COLUMN 23

Line 12, "if" should read --is--;
Table 5, should read
--

| | Sheet resistance value (Ω/□) |
|---|---|
| Embodiment 5 | $3 \times 10^{-9}$ |
| Embodiment 6 | $8 \times 10^{-8}$ |
| Embodiment 7 | $2 \times 10^{-9}$ |
| Embodiment 8 | $6 \times 10^{-8}$ |

--; and

Line 23, "value" should read --value of--.

UNITED STATES PATENT AND TRADEMARK OFFICE

CERTIFICATE OF CORRECTION

PATENT NO. : 6,849,999 B1
APPLICATION NO. : 09/440535
DATED : February 1, 2005
INVENTOR(S) : Tamaki Kobayashi et al.

It is certified that error appears in the above-identified patent and that said Letters Patent is hereby corrected as shown below:

COLUMN 24

Line 52, “photolythography” should read --photolithography--;
Line 65, “pattering” should read --patterning--; and
Line 67, “photolythog-” should read --photolithog- --.

COLUMN 25

Line 33, “aceton” should read --acetone--.

COLUMN 27

Line 37, “83.),” should read --83),--; and
Line 43, “flit” should read --frit--.

COLUMN 28

Line 59, “has” should read --have--.

Signed and Sealed this

Tenth Day of October, 2006

JON W. DUDAS
*Director of the United States Patent and Trademark Office*